US009434055B2

(12) United States Patent
Tunningley et al.

(10) Patent No.: US 9,434,055 B2
(45) Date of Patent: Sep. 6, 2016

(54) REPLACEABLE GRIPPING INSERTS FOR WRENCHES

(71) Applicant: Ridge Tool Company, Elyria, OH (US)

(72) Inventors: James Tunningley, Lakewood, OH (US); Jason J. Boggs, South Amherst, OH (US); Glen R. Chartier, Avon Lake, OH (US)

(73) Assignee: Ridge Tool Company, Elyria, OH (US)

( * ) Notice: Subject to any disclaimer, the term of this patent is extended or adjusted under 35 U.S.C. 154(b) by 263 days.

(21) Appl. No.: 14/202,611

(22) Filed: Mar. 10, 2014

(65) Prior Publication Data

US 2014/0290445 A1 Oct. 2, 2014

Related U.S. Application Data

(63) Continuation-in-part of application No. 13/908,316, filed on Jun. 3, 2013, now Pat. No. 9,205,539.

(60) Provisional application No. 61/884,221, filed on Sep. 30, 2013.

(30) Foreign Application Priority Data

Apr. 1, 2013 (IN) ..... 1263/MUM/2013

(51) Int. Cl.

| | |
|---|---|
| ***B25B 13/58*** | (2006.01) |
| ***B25B 13/50*** | (2006.01) |
| ***E21B 19/16*** | (2006.01) |
| ***B25B 13/28*** | (2006.01) |

(52) U.S. Cl.

CPC ..... *B25B 13/505* (2013.01); *B25B 13/28* (2013.01); *E21B 19/161* (2013.01)

(58) Field of Classification Search

CPC ..... B25B 13/505; B25B 13/52; B25B 13/28; B25B 13/5025; B25B 13/5041; E21B 19/16; E21B 19/161

See application file for complete search history.

(56) References Cited

U.S. PATENT DOCUMENTS

| | | | |
|---|---|---|---|
| 379,123 | A | 3/1888 | Parmelee |
| 590,853 | A | 9/1897 | Parmelee |
| 608,202 | A | 8/1898 | Kleckner |
| 626,401 | A | 6/1899 | Wiegand |
| 648,706 | A | 5/1900 | Parmelee |
| 701,237 | A | 5/1902 | Wight |

(Continued)

FOREIGN PATENT DOCUMENTS

| | | |
|---|---|---|
| CN | 2116561 | 2/1992 |
| CN | 2150020 | 8/1992 |

(Continued)

OTHER PUBLICATIONS

International Search Report (ISR) and Written Opinion; PCT/US2015/015312; Jun. 29, 2015 (12 pages).

*Primary Examiner* — David B Thomas

(74) *Attorney, Agent, or Firm* — Mark E. Bandy; Rankin, Hill & Clark LLP

(57) ABSTRACT

Gripping inserts used in a wrench having a collection of moveably positionable jaws which is pivotally affixed to a handle are described. The wrench and gripping inserts find particular application in drilling industries. Also described are particular materials and characteristics for the gripping inserts. In addition, methods for configuring and/or sizing the gripping inserts are described.

26 Claims, 15 Drawing Sheets

(56) References Cited

U.S. PATENT DOCUMENTS 747,612 A 12/1903 Jones
791,814 A 6/1905 Pitzer
807,258 A 12/1905 Foggan
871,436 A 11/1907 Parmelee
878,388 A 2/1908 Heimann
917,440 A 4/1909 Hughes
958,698 A * 5/1910 Dunn ..... B25B 13/505 81/90.5
1,004,792 A 10/1911 Bessolo
1,072,320 A 9/1913 Dunham
1,093,496 A 4/1914 Stringfellow
1,128,467 A 2/1915 Lewis
1,161,777 A 11/1915 La Rock
1,177,620 A 4/1916 Hardeman
1,310,995 A 7/1919 Langford
1,334,250 A 3/1920 Langford
1,380,513 A 6/1921 Zilen et al.
1,401,964 A 1/1922 Cromwell
1,443,568 A * 1/1923 Dunn ..... B25B 13/52 81/90.5
1,454,016 A 5/1923 Steen
1,483,486 A 2/1924 Scott
1,544,807 A 7/1925 Childs
1,548,344 A 8/1925 Bessolo
1,556,169 A 10/1925 Smith
1,584,861 A 5/1926 Jones
1,593,000 A 7/1926 Wilson
1,611,808 A * 12/1926 Bessolo ..... B25B 13/52 81/90.2
1,718,719 A 6/1929 Turner
1,763,135 A 6/1930 Cox
2,047,506 A 7/1936 Hertel
2,209,988 A 8/1940 Matlock
2,278,439 A 4/1942 Grau et al.
2,291,620 A 8/1942 Grau
2,310,246 A 2/1943 Lundeen
2,329,181 A 9/1943 Boynton
2,339,760 A 1/1944 Boynton
2,423,326 A 7/1947 Jones
2,465,695 A 3/1949 Osborne
2,517,366 A * 8/1950 Wilson ..... B25B 13/505 279/123
2,550,963 A * 5/1951 Brinkley ..... B25B 7/04 81/186
2,557,202 A 6/1951 Raymond et al.
2,557,342 A * 6/1951 Cole ..... B25B 13/505 200/11 G
2,637,236 A 5/1953 Vergnani et al.
2,714,321 A 8/1955 Tamplin
2,720,128 A * 10/1955 Woolley ..... B25B 7/02 81/186
2,967,446 A 1/1961 Martois
3,024,128 A * 3/1962 Dawson ..... C23C 24/103 427/376.6
3,097,552 A 7/1963 Kelley
3,669,850 A 6/1972 Draca
3,703,111 A 11/1972 Guier
3,832,918 A 9/1974 Lang et al.
4,075,392 A * 2/1978 Jaeger ..... B23K 35/30 427/236
4,194,419 A 3/1980 Mitchhart et al.
4,277,876 A * 7/1981 Livesay ..... B23P 19/06 29/402.01
4,403,801 A 9/1983 Huff et al.
4,643,740 A * 2/1987 Nicolson ..... B23K 1/0004 428/698
4,712,284 A 12/1987 Coyle, Sr. et al.
4,714,289 A 12/1987 Arzenti et al.
4,759,239 A 7/1988 Hamilton et al.
4,893,528 A 1/1990 Chung-Hsing
4,989,909 A 2/1991 Bouligny, Jr. et al.
5,094,132 A 3/1992 Engel
5,223,332 A * 6/1993 Quets ..... C23C 4/02 428/216
5,230,264 A 7/1993 Kindling
5,231,899 A 8/1993 Lee
5,287,777 A 2/1994 Kolodziej
5,435,214 A 7/1995 Sisson
5,452,886 A 9/1995 Cote et al.
5,535,647 A 7/1996 Donaldson
5,535,650 A 7/1996 McNatt
5,537,900 A 7/1996 Schaar
5,653,297 A 8/1997 Whisenhunt
5,746,097 A 5/1998 McCann
5,768,958 A 6/1998 Gamble
5,791,206 A 8/1998 Daigle et al.
5,829,327 A 11/1998 Stanton
5,865,073 A 2/1999 Wilson et al.
5,927,159 A 7/1999 Yokoyama et al.
5,941,142 A 8/1999 Janson
5,996,444 A 12/1999 Pearce et al.
6,055,888 A 5/2000 Mitchell
6,116,118 A 9/2000 Wesch, Jr.
6,131,491 A 10/2000 Hirse
6,341,543 B1 1/2002 Hsieh
6,349,621 B1 2/2002 Khachatoorain
6,378,399 B1 4/2002 Bangert
6,439,064 B1 * 8/2002 Fanguy ..... B25B 13/5016 73/862.25
6,488,323 B1 12/2002 Bouligny
6,530,297 B2 3/2003 McCann
6,537,140 B1 3/2003 Miller et al.
6,568,301 B2 5/2003 Huang
6,755,097 B2 6/2004 Bangert
6,799,493 B2 10/2004 Wang
6,938,519 B2 9/2005 Boyd et al.
6,978,701 B1 12/2005 Buchanan
6,988,430 B1 1/2006 Putney et al.
7,036,397 B2 5/2006 Bangert
7,111,529 B2 9/2006 Pradelski
7,197,964 B2 4/2007 Buchanan
7,665,514 B2 2/2010 Patterson
7,721,628 B2 * 5/2010 Lorger ..... B25B 13/5016 81/57.33
7,913,589 B2 3/2011 Chen
8,056,195 B2 * 11/2011 Zwier ..... A01G 1/08 24/545
8,453,542 B2 6/2013 Gouws
8,808,870 B2 * 8/2014 Zheng ..... B22F 7/04 428/548
8,876,396 B2 * 11/2014 Guilford ..... F16C 13/006 384/24
2005/0188793 A1 9/2005 Cherry
2006/0248985 A1 * 11/2006 Bangert ..... E21B 19/07 81/57.15
2008/0307929 A1 12/2008 Lorger et al.
2010/0122608 A1 5/2010 Chen
2010/0282033 A1 11/2010 Buchanan
2011/0138972 A1 6/2011 Wojick
2011/0203420 A1 8/2011 Riestra
2011/0209586 A1 9/2011 Wojick
2011/0232427 A1 9/2011 Streater et al.
2013/0095731 A1 * 4/2013 Manning ..... B24B 1/00 451/28
2013/0232750 A1 * 9/2013 Pullins ..... E21B 19/10 29/402.09

FOREIGN PATENT DOCUMENTS

CN 2161425 5/1993
CN 2181374 9/1993
CN 1139037 1/1995
CN 2275013 5/1996
CN 2271949 9/1996
CN 2291258 5/1997
CN 2356809 1/2000
CN 2657863 9/2003
CN 2656087 10/2003
CN 2685007 2/2004
CN 2782307 1/2005
CN 2770880 3/2005
CN 2923201 5/2006
CN 201046558 6/2006
CN 2930983 7/2006

(56) References Cited

FOREIGN PATENT DOCUMENTS

| | | |
|---|---|---|
| CN | 201098856 | 7/2007 |
| CN | 201115940 | 11/2007 |
| CN | 201342650 | 2/2009 |
| CN | 201744941 | 12/2009 |
| CN | 201632962 | 1/2010 |
| CN | 201659522 | 4/2010 |
| CN | 201856195 | 11/2010 |
| CN | 202344440 | 9/2011 |
| CN | 202377960 | 12/2011 |
| CN | 202377960 | 8/2012 |
| WO | 2009093763 | 1/2008 |
| WO | 2011089297 | 1/2010 |

* cited by examiner

REPLACEABLE GRIPPING INSERTS FOR WRENCHES

CROSS REFERENCES TO RELATED APPLICATIONS

This is a continuation-in-part (CIP) application of U.S. Ser. No. 13/908,316 filed Jun. 3, 2013, which claims priority on Indian application 1263/MUM/2013 filed Apr. 1, 2013. This application also claims priority upon U.S. provisional application Ser. No. 61/884,221 filed Sep. 30, 2013.

FIELD

The present subject matter relates to replaceable gripping inserts for tools such as wrenches. The present subject matter also relates to tools using the gripping inserts for engaging cylindrical components typically used in drilling operations. The present subject matter also relates to methods for configuring the gripping inserts.

BACKGROUND

Core barrel assemblies are used in a variety of drilling industries such as in the fields of ore mining, petroleum drilling, water well drilling, and geotechnical drilling and surveying industries. Core barrel assemblies are used to obtain a core sample at an end of a drilling passage. Typical core barrel assemblies include an inner tube assembly and an outer tube assembly. The outer tube assembly contains the inner tube assembly and provides engagement to other drilling components such as a drill string or collection of drill rods.

During a core sampling operation, after collecting a core sample from a bottom region of a drill hole, the inner tube assembly contains the core sample. The inner tube and core sample are retrieved from the bottom of the drill hole using a wire line that is pulled through the drill rods.

Depending upon the configuration of the core barrel assembly and/or the inner tube, a variety of components may be engaged with the inner tube such as a core barrel head and a core lifter. These components and potentially others are engaged with the inner tube by threaded connections. These threaded connections must be disengaged from one another in order to remove the core sample.

Engaging or disengaging threaded components with an inner tube such as in accessing a core sample contained in the inner tube, can be problematic. Relatively high levels of torque may be required. Dirt and debris may cover the components and/or threads. Exposure and contact with core drilling fluids may pose additional problems. Bentonite clay drilling fluids contain clay particles and can be slightly corrosive. Drilling fluids may also include polymer filtration control and stabilizers, lubricants such as drill rod grease, and cutting oils. The presence of these agents on the inner tube and/or threaded regions, can further impede engagement or disengagement operations particularly in situations when the outer surface of the tube contains lubricious agents.

Core barrel assemblies are typically machined assemblies with relatively high tolerances. Thus, it is important to not damage the outer surface of the inner tube such as by using a traditional pipe wrench. Typical pipe wrenches have pipe engaging faces with teeth that can form "digs," burrs, or other surface defects on the outer surface of the inner tube. In addition, if excessive force is applied by a pipe wrench, the inner tube can be deformed.

In view of these and other reasons, the drilling industry typically uses specialized wrenches with a friction coating to grip core barrel assemblies and particularly inner tubes. Although satisfactory in certain aspects, a need remains for an improved tool and related methods for securely engaging core barrel components such as an inner tube, without damaging the component.

SUMMARY

The difficulties and drawbacks associated with previously known practices and tools are addressed in the present gripping inserts, wrenches using such gripping inserts, and related methods of use.

In one aspect, the present subject matter provides a replaceable gripping insert adapted for use in a wrench having a plurality of jaw members. At least some of the jaw members have provisions to receive and retain the gripping insert. The gripping insert comprises a substrate defining a concave inner face. The substrate exhibits a Rockwell Hardness C along the inner face within a range of from 40 to 49. The gripping insert also comprises a layer including a metal carbide disposed along the inner face of the substrate and bonded thereto. The layer defines an exposed gripping surface.

In another aspect, the present subject matter provides a wrench comprising a handle defining a first end and a second end opposite from the first end. The wrench also comprises a first jaw having a proximal end, a distal end, the first jaw defining an interior face, and the proximal end of the first jaw pivotally attached to the first end of the handle. The wrench also comprises a second jaw having a proximal end, a distal end, the second jaw defining an interior face, and the proximal end of the second jaw pivotally attached to the distal end of the first jaw at a first joint assembly. The wrench additionally comprises a third jaw having a proximal end, a distal end, the third jaw defining an interior face, the proximal end of the third jaw pivotally attached to the distal end of the second jaw at a second joint assembly, and the distal end of the third jaw being releasably engageable with the first end of the handle. The wrench also comprises at least one gripping insert attached to an interior face of at least one of the first jaw, the second jaw, and the third jaw. The gripping insert includes (i) a substrate defining a concave inner face, the substrate exhibiting a Rockwell Hardness C along the inner face within a range of from 40 to 49, and (ii) a layer including a metal carbide disposed along the inner face of the substrate and bonded thereto, the layer defining an exposed gripping surface.

In still another aspect, the present subject matter provides a wrench comprising a handle defining a first end and a second end. The wrench also comprises a plurality of hingedly connected jaw members. The plurality of jaw members include a primary jaw member pivotally attached to the first end of the handle and a terminal jaw member engageable with the handle. Each of the plurality of jaw members defines an interior face. The wrench additionally comprises at least one gripping insert attached to an interior face of at least one of the plurality of jaw members. The gripping insert includes a substrate defining a concave inner face. The substrate exhibits a Rockwell Hardness C along the inner face within a range of from 40 to 49. The gripping insert also includes a layer including a metal carbide disposed along the inner face of the substrate and bonded thereto. The layer defines an exposed gripping surface.

In yet another aspect, the present subject matter provides a method for evaluating whether use of proposed gripping inserts in a wrench with a particular tube is within a specified factor of safety. The method comprises identifying an inner diameter of the tube, an outer diameter of the tube, a modulus of elasticity of the tube, and Poisson's ratio of the tube. The method also comprises proposing a modulus of elasticity of the gripping inserts, and Poisson's ratio of the gripping inserts. The method also comprises proposing an inner diameter of the gripping inserts, an outer diameter of the gripping inserts, and a circumferential length of the gripping inserts. The method also comprises calculating a circumferential pressure P using the proposed gripping inserts, wherein the circumferential pressure P is calculated via Equations (IV) and (V). The method also comprises determining a gripping ratio GR using the proposed gripping inserts. The method also comprises calculating an adjusted pressure P' using Equation (VI). The method additionally comprises identifying a maximum yield value for the tube, $P_{MAX}$. The method also comprises specifying a minimum factor of safety, $FS_{MIN}$. The method also comprises calculating a factor of safety, $FS_{CALC}$ using Equation (VII). The method further comprises comparing the calculated factor of safety $FS_{CALC}$ to the minimum factor of safety $FS_{MIN}$. If the calculated factor of safety $FS_{CALC}$ is less than or equal to the minimum factor of safety $FS_{MIN}$, then the proposed gripping inserts are within the specified factor of safety. If the calculated factor of safety $FS_{CALC}$ is greater than the minimum factor of safety $FS_{MIN}$, then the proposed gripping inserts are not within the specified factor of safety.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

Figure 1:
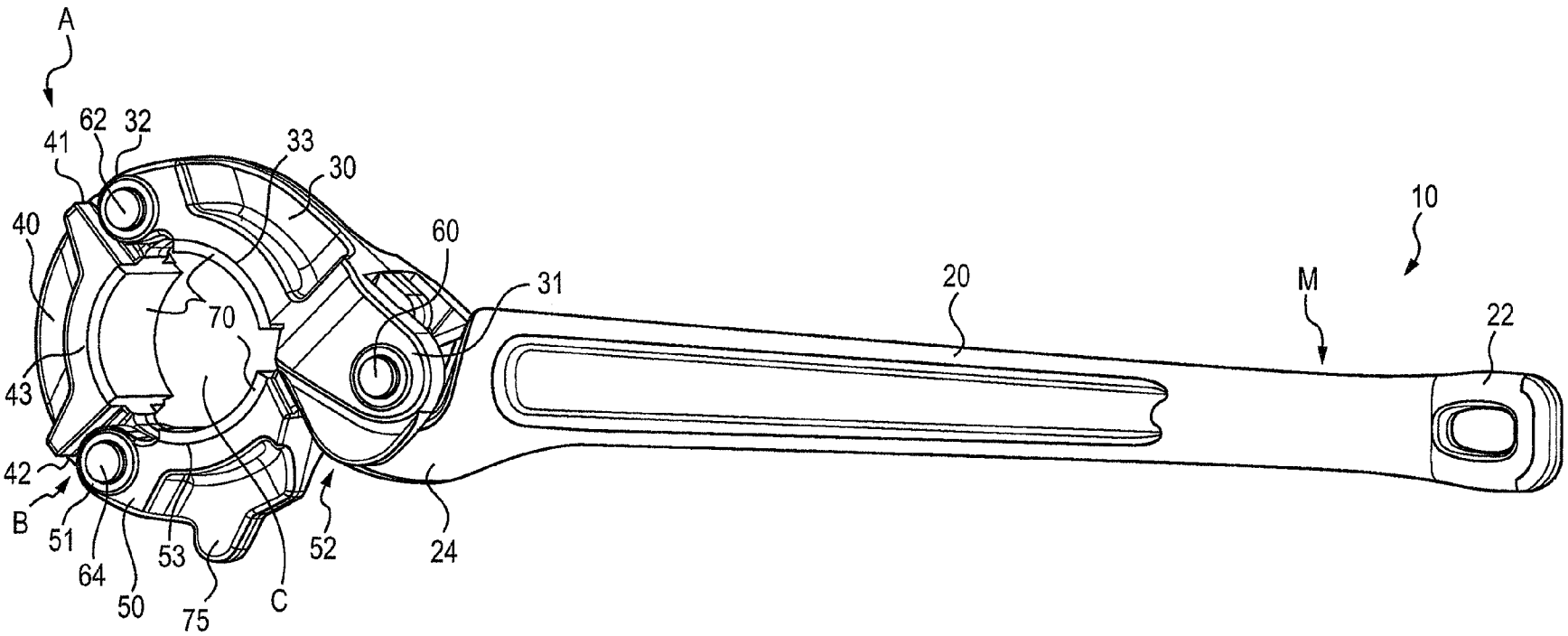
FIG. 1 is a perspective view of a wrench in accordance with the present subject matter.

The present subject matter provides wrenches which are uniquely adapted for use in engaging and disengaging components associated with core barrel assemblies. Although the wrenches of the present subject matter are described herein as for use with inner tubes of core barrel assemblies, it will be appreciated that the present subject matter wrenches are applicable to other uses and industries besides the drilling industry. Generally, the present subject matter wrenches comprise a handle and a plurality of hingedly or pivotally connected jaw members. The collection of jaw members are positionable between an open position in which an inner tube or other component can be positioned within a gripping region defined by the jaws; and a closed position in which the jaws engage the workpiece disposed in the gripping region.

In certain versions of the present subject matter, the wrenches also include particular friction materials located along inner faces of the jaws which promote friction engagement with an inner tube or other component positioned or located in the gripping region.

In certain versions of the present subject matter, the wrenches also include one or more biasing members such as springs to bias the jaws or plurality of jaws to particular positions. In particular, certain versions of the wrenches include biasing members which bias or urge the jaws to a closed position. However, the present subject matter also includes configurations in which the jaws are biased to an open position.

In certain versions of the present subject matter, the wrenches also include one or more provisions which facilitate grasping one or more jaw members. For example, a projection or outwardly extending member can be provided on one or more of the jaws which can be grasped by a user.

In certain versions of the present subject matter, the wrenches also include provisions that limit articulation, angular position, and/or movement of one or more jaws. These provisions can be incorporated in the wrenches to limit the extent of opening of the jaws.

In certain versions of the present subject matter, the wrenches also include provisions that impart a particular contact pattern to an inner tube or other cylindrical component located in the gripping region during engagement of the jaws to the tube. As loads are increasingly applied to the inner tube, the particular contact pattern increases contact surface area and promotes a more uniform application of friction and force transfer between the wrench and the inner tube.

In certain versions of the present subject matter, the wrenches also include provisions that utilize a particular engagement configuration and a contact angle between a jaw and a handle or associated component of the wrench. The engagement configuration facilitates transfer of forces between the components during use of the wrench.

In certain versions of the present subject matter, the wrenches also utilize a stop feature which prevents transfer of excessive levels of force to an inner tube during use of the wrench.

In still other versions of the present subject matter, the wrenches also include a self-locking feature in which closing of the plurality of jaws about an inner tube is further promoted during use of the wrench.

And in certain versions of the subject matter, the wrenches include covers or guards to limit access to a region at which engagement between a jaw and a handle occurs, during use of the wrench.

In certain versions of the present subject matter, particular gripping inserts are provided that can be used with the wrenches. The gripping inserts are replaceable and can be engaged to and removed from jaws of the wrenches. In particular versions, the gripping inserts are sized based upon a combination of factors to provide a targeted and desired force to a workpiece or component to be gripped.

In still other versions of the present subject matter, specific methods and strategies are provided for configuring and/or sizing the gripping inserts.

Again, it will be understood that in no way are the wrenches or gripping inserts of the present subject matter limited to use with inner tubes of core barrel assemblies. Instead, it is contemplated that the wrenches and/or gripping inserts could be used in a variety of other fields and applications. Furthermore, it will be appreciated that the present subject matter includes wrenches and/or gripping inserts with one or more features or aspects and combinations of these features or aspects. Details of the various features and aspects of the wrenches and gripping inserts of the present subject matter are as follows.

Figure 2:
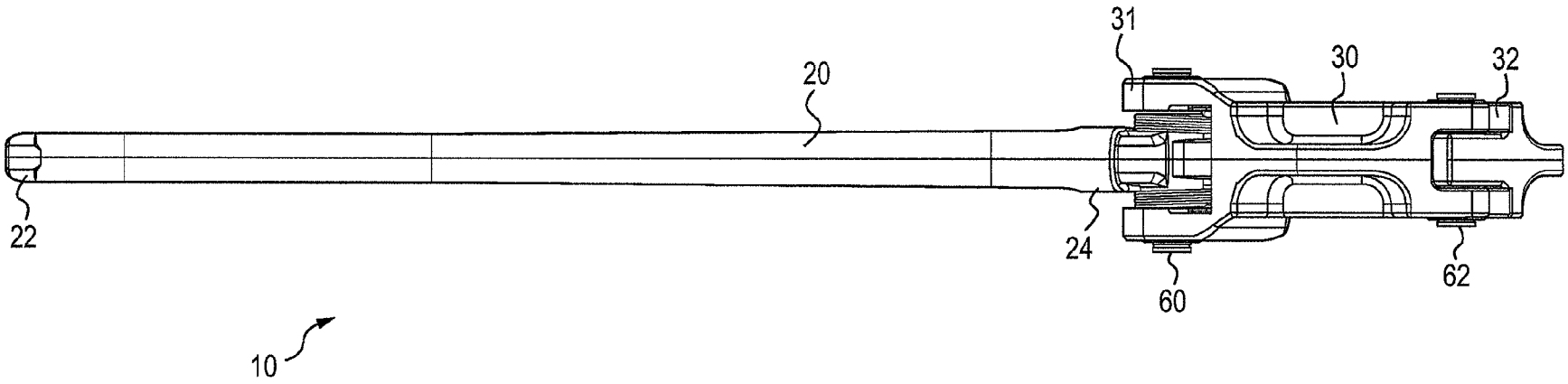
FIG. 2 is a top planar view of the wrench depicted in FIG. 1.

FIG. 1 illustrates a perspective view of a wrench 10 in accordance with the present subject matter. FIG. 2 is a top planar view of the wrench 10 shown in FIG. 1. The wrench 10 comprises a handle 20 having a proximal end 22 and a distal end generally shown as 24. The wrench 10 also comprises a plurality of jaw members or jaw portions. In the version depicted in FIG. 1, the wrench 10 comprises a first or primary jaw 30, a second jaw 40, and a third or terminal jaw 50. It will be understood that the present subject matter wrenches can utilize a lesser number of jaws such as two, or a greater number of jaws such as four, five, six, or more.

As described in greater detail herein, the wrench 10 is used by positioning a workpiece (not shown) within a gripping region C defined by the plurality of jaws. As a force is applied to the handle 20 such as shown for example in FIG. 1 by arrow M, the gripping region C constricts about, contacts, and engages the inner tube. Details as to each of these aspects and other features are provided herein. With further reference to FIG. 1, the first jaw 30 defines a proximal end 31 and a distal end 32. The second jaw defines a proximal end 41 and a distal end 42. The third jaw 50 defines a proximal end 51 and a distal end 52. Each jaw member also defines an inwardly directed face. Thus, the first jaw member 30 defines an interior face 33, the second jaw member 40 defines an interior face 43, and the third jaw member 50 defines an interior face 53. The proximal end 31 of the first jaw 30 is pivotally attached to the distal end 24 of the handle 20. Although various assemblies and configurations can be utilized, a pivot pin 60 extending through aligned apertures defined in the first jaw 30 and the handle 20 is depicted in the version of FIG. 1. The distal end 32 of the first jaw 30 is pivotally attached to the proximal end 41 of the second jaw 40 at a first joint assembly generally referenced as joint A in FIG. 1. In the version of FIG. 1, a pivot pin 62 extends through aligned apertures defined in the first jaw 30 and the second jaw 40. The distal end 42 of the second jaw 40 is pivotally attached to the proximal end 51 of the third jaw 50 at a second joint assembly generally referenced as joint B in FIG. 1. In the version shown in FIG. 1, a pivot pin 64 extends through aligned apertures defined in the second jaw 40 and the third jaw 50. One or more snap rings or retaining components can be used in association with the pivot pins 60, 62, and/or 64. Additional engagement provisions are provided between the third jaw 50 and the handle 20 and particularly at the distal end 52 of the third jaw 50 and the distal end 24, or proximate the distal end 24, of the handle 20. These engagement provisions are described in greater detail herein.

Figure 3:
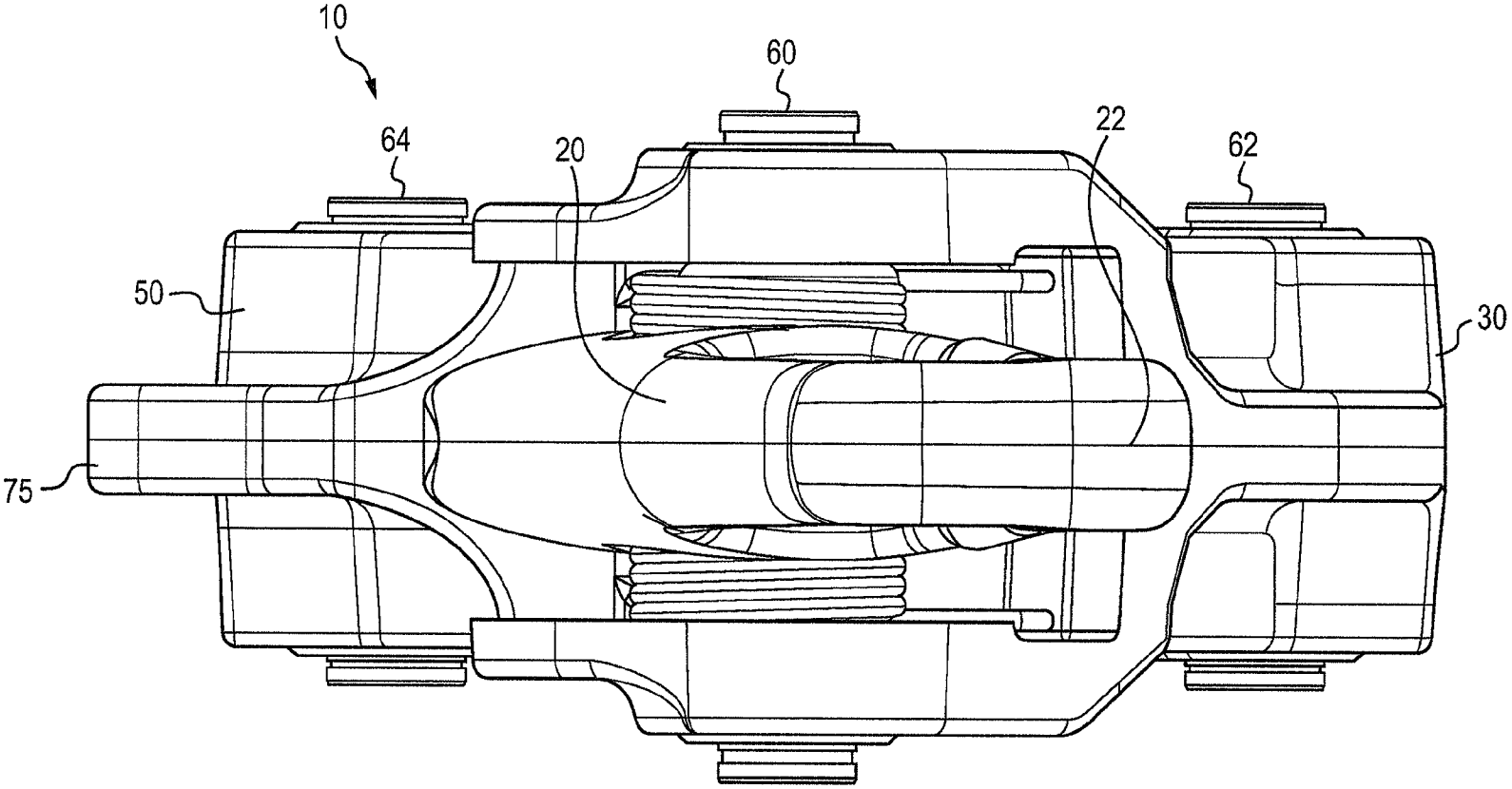
FIG. 3 is an end view of the wrench of FIG. 1.
Figure 4:
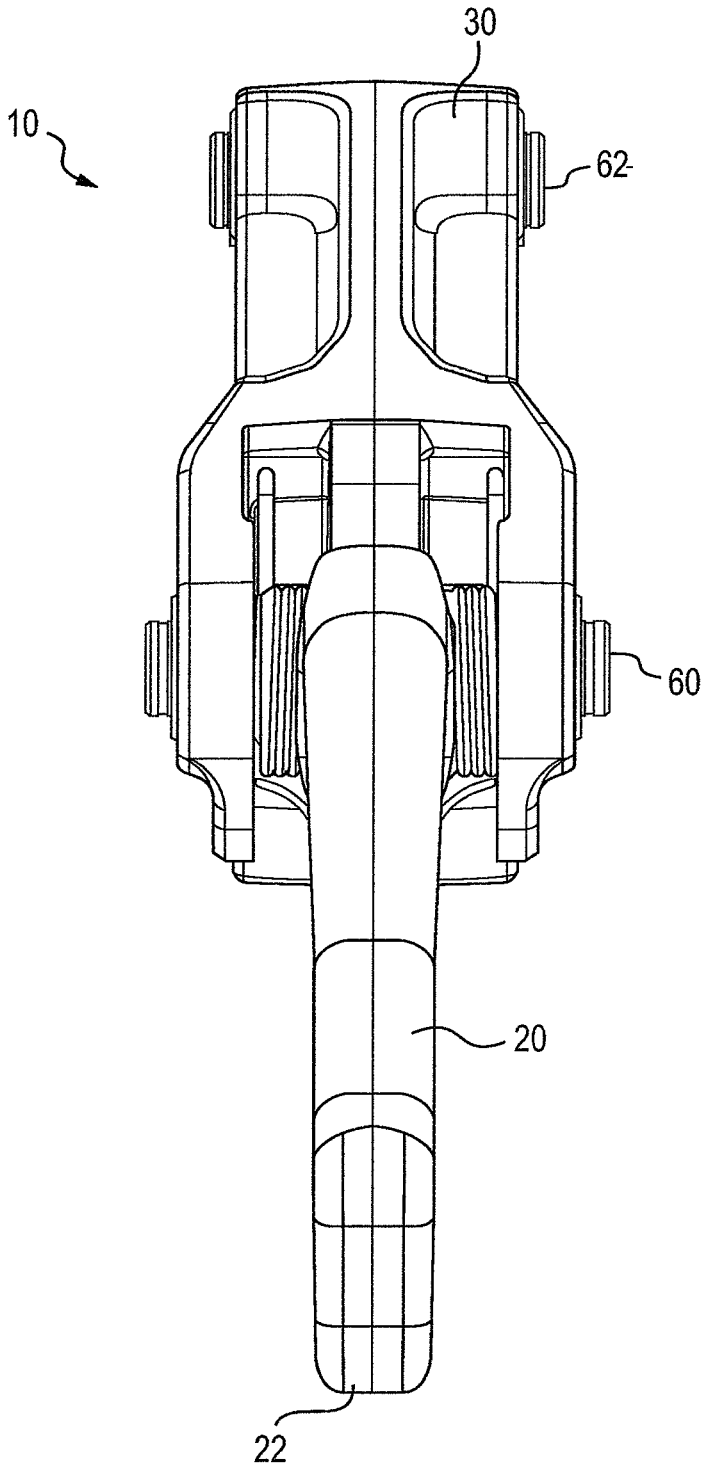
FIG. 4 is another end view of the wrench of FIG. 1.

FIGS. 3 and 4 illustrate end views of the wrench 10 depicted in FIG. 1. FIGS. 3 and 4 illustrate additional aspects of the wrench.

The wrench 10 may also include one or more regions of a friction material to promote engagement with an inner tube or other component. In the version shown in FIG. 1, the wrench 10 comprises friction material 70 disposed on each of the interior faces 33, 43, and 53 of the first jaw 30, second jaw 40, and third jaw 50, respectively. The friction material can be provided in a variety of different forms and arrangements. Generally, the friction material is in the form of a layer or region disposed on at least a portion of an interior face of a jaw. In certain versions of the present subject matter, the friction material includes a metallic carbide material such as but not limited to tungsten carbide. In certain versions of the present subject matter, the friction material includes one or more fibrous materials such as populations of one or more fiber types. The fibers may be in an organized arrangement such as in a woven collection, or may be nonwoven. In certain versions, the friction material is compressible as described in greater detail herein. For versions in which the friction material includes fibers, the fibers are typically metallic fibers, polymeric fibers, glass fibers, or combinations thereof. In particular versions, the friction material can be in the form of glass fibers dispersed in a polymeric matrix. A wide array of metallic fibers can be used such as for example, but not limited to, steel, brass, magnesium, and combinations thereof. Nonlimiting examples of polymeric fibers include polyamide and particularly poly(paraphenylene terephthalamide), which is also known as KEVLAR®. Combinations of metallic agents, polymeric components, and other materials can be used in various proportions and arrangements for the friction material. In many versions of the present subject matter, the friction material is free of asbestos.

As previously noted, in certain versions of the present subject matter, the friction material is compressible. This aspect can be quantified by reference to a typical range of elastic modulus values for the friction material. Thus, in certain versions, the friction material exhibits an elastic modulus within a range of from 15 ksi to 1,500 ksi.

The friction material can be carried or secured to one or more removable members such as carrier elements that in turn are engageable along the interior faces of the jaws. It is also contemplated that the friction material can be directly attached to the interior faces of the jaws. A wide array of engagement techniques and/or provisions can be used to attach or affix the friction material to carrier elements and/or to the jaws. For example, mechanical engagement can be used such as rivots, threaded fasteners, pins, screws, or other components. The friction material can be attached or affixed to carrier elements and/or to the jaws by sintering techniques to metallurgically bond the friction material to its underlying substrate. The use of adhesives is also contemplated to adhesively bond friction materials to carrier elements and/or to the jaws. The friction material can also be applied or otherwise formed upon carrier elements or the jaws by coating or spraying techniques.

In certain versions of the present subject matter, the outer exposed face of the friction material can be provided or formed to exhibit a collection of recesses or passages that extend across at least a portion of the friction material face. Such a configuration may be beneficial in instances when debris and particularly a liquid film is disposed on an outer surface of the inner tube or other component. As the face of the friction material contacts the inner tube, the debris and/or liquid film are urged toward and displaced within the recesses or passages defined in the face of the friction material, thereby promoting intimate contact between the friction material and the surface of the inner tube. Thus, in certain versions of the wrench, the faces of the friction material have a collection of recesses extending along at least a portion of the face. The collection of recesses have a size and/or configuration sufficient to receive liquid and/or debris from the outer surface of the inner tube.

In many embodiments of the present subject matter, the regions of friction material such as regions 70 are provided in the form of replaceable gripping inserts.

In certain versions of the present subject matter, the replaceable gripping inserts are located along inner faces of the jaws which promote frictional engagement with an inner tube of a drilling bore assembly or other component positioned or located in the gripping region.

Each gripping insert includes a concave face for contacting an outer circumferential surface of a pipe or tube to be gripped. The material, thickness, and coarseness of the inserts can be selected based upon the particular requirements of the application.

In particular versions of the present subject matter, the concave gripping face or surface of the inserts is coated with one or more metallic carbides such as for example tungsten carbide. The tungsten carbide can be deposited by an electro-deposition process as described in greater detail herein. Electro-deposition is a particular method but the present subject matter includes other methods of depositing tungsten carbide and/or other metallic carbides on the gripping surface of the inserts.

In certain versions of the present subject matter, the gripping inserts include an iron substrate and in particular a wrought iron substrate. Nonlimiting examples of wrought irons include wrought 4140 and D-4512. Another example of materials for the substrate are steels. The present subject matter includes the use of a wide array of materials for the substrate such as for example a powdered metal substrate commercially available under the designation FN-0208-105HT, which is a standardized metal material believed to be a nickel steel. Nearly any material can be used for the substrate of the gripping inserts so long as it is electrically conductive and sufficiently hard as described herein.

Regardless of the material selected for the gripping insert substrate, in many embodiments of the present subject matter, the substrates exhibit a particular hardness along their inner face, i.e., the face directed toward a workpiece or tube to be gripped and which is coated with one or more metallic carbides. In certain embodiments, the substrate inner face exhibits a Rockwell Hardness C of from about 40 to about 49, more particularly from 45 to 48, and in certain embodiments 47. Rockwell Hardness and its measurement are described in standards ASTM E18 and ISO 6508-1.

For the noted embodiments, the hardness of the inner face of the gripping inserts should be relatively hard and within the noted ranges of Rockwell Hardness. If the inner face of the substrate is too hard, i.e., having a Rockwell Hardness greater than about Rockwell Hardness C 50, the gripping insert will potentially be too brittle and be unable to withstand typical end use conditions. If the hardness of the inner face of the substrate is too soft, for example less than about Rockwell Hardness C 38, then the metal carbide particles or agglomerates will be pressed into the inner face of the substrate of the gripping insert during use.

As previously noted, the gripping inserts typically include a thin layer of a metal carbide and particularly a thin layer of tungsten carbide disposed on the inner face of the substrate of the gripping insert. Typically, the thickness of the metal carbide layer is within a range of from 0.0045 inches (114.3 microns) to 0.0075 inches (190.5 microns). However, it will be appreciated that the present subject matter includes metal carbide layers having thicknesses greater than and/or less than these values.

A variety of techniques can be used to form or otherwise deposit the metal carbide onto the inner face of the gripping inserts. A nonlimiting example of such a process is electro-deposition. During electro-deposition, electric current passes through a source of the metal carbide and the substrate, thereby causing the metal carbide material to increase in temperature and either melt or otherwise fuse to the underlying substrate, thereby forming a thin layer of the metal carbide.

In certain methods of the present subject matter, when depositing tungsten carbide on the gripping inserts, other surfaces of the insert can be masked to preclude deposition of the tungsten carbide thereon. This practice maintains dimensions of the insert and ensures that the insert properly fits within its receiving region along an inner face of a jaw or wrench. Proper seating and positioning of the inserts is desirable so that the wrench, its components, and the gripping inserts can withstand typically applied and relatively high loads.

Each gripping insert can be attached to a jaw of the wrench by a threaded fastener. However, the present subject matter includes other components and methods for attaching the gripping inserts to the jaws.

The thickness of the gripping inserts can also be varied to enable a wrench to be used with particular diameter pipes or tubes.

In a particular version of the present subject matter, the circumferential or arcuate length of each insert is such that the total circumferential or arcuate length of a collection of inserts used in a wrench is greater than one-half of the circumference of the pipe or tube to be gripped. Restated, upon incorporation within a wrench the gripping inserts extend around and contact at least 180° around the perimeter of a pipe or tube of interest.

In another aspect of the present subject matter, each gripping insert is provided having particular proportions. The proportions are such that the circumferential or arcuate length dimension as measured along a gripping face of an insert is greater than ⅔ of the width of the gripping face of the insert. The width dimension of a gripping insert extends parallel or substantially so with a center axis of a tubular workpiece upon affixment of an insert and use in a wrench on the tubular workpiece. The length dimension of a gripping insert is transverse to the width dimension. Additional details of the gripping inserts are provided herein.

The wrenches of the present subject matter may also comprise one or more biasing members that urge one or more jaws to a particular position relative to the handle and/or to other jaws. In certain versions, a biasing member such as a double torsion spring is positioned between the first jaw 30 and the distal end 24 of the handle 20. For example, the biasing member can be disposed about the pivot pin 60 and can be configured to bias the jaw 30 (and jaws 40 and 50 attached thereto) to a particular position such as an open position or a closed position. Many of the wrenches of the present subject matter are configured such that the plurality of jaws, e.g., jaws 30, 40, and 50, are biased to a closed position. A double torsion spring or other biasing member can be used and positioned about the pivot pin 60 to provide such action.

Figure 14:
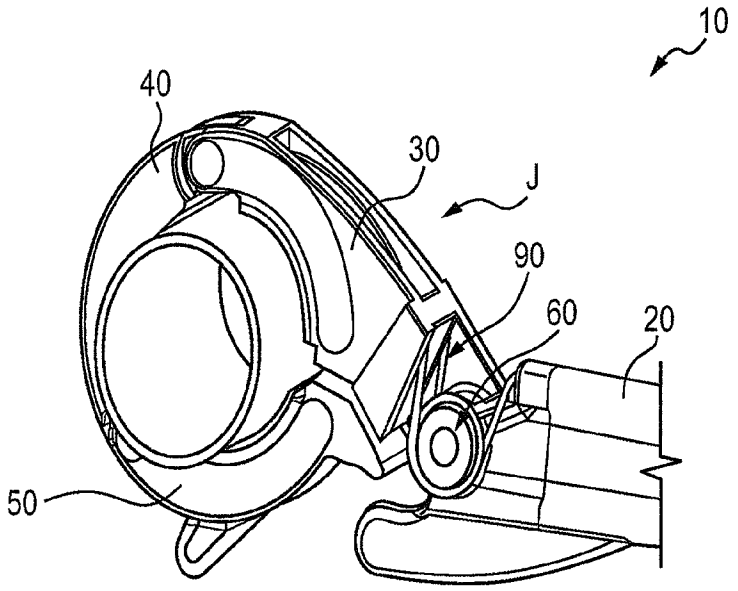
FIG. 14 is a view of a plurality of jaws and a biasing member used in a wrench in accordance with the present subject matter.

FIG. 14 illustrates provision of a biasing member 90 between the primary jaw, e.g., the jaw 30, and the handle 20. In the particular version of the wrench depicted in FIG. 14, the biasing member 90 is provided in the form of a double torsional spring. The spring can be positioned about the pivot pin 60. In a particular version of the present subject matter, the spring is configured to urge the primary jaw 30 about the pin 60 toward a closed position, e.g., in the direction of arrow J. It will be understood that the present subject matter includes variations of the particular embodiment depicted in FIG. 14.

Biasing the plurality of jaws to a closed position can be useful when using the wrench. This action tends to simulate a ratcheting action so that a user can readily apply torque to an inner tube through a sweep or path of angular displacement of the wrench handle, and then reverse motion of the wrench without excessive opening of the jaws. That is, during reversing of the wrench, the plurality of jaws remain closely positioned but slide about the inner tube due to the biasing action of the spring or other member urging the jaws toward a closed position.

The present subject matter also includes the use of biasing members provided between adjacent second and third jaws such as at Joint A and/or Joint B. Such joint biasing provisions can be utilized independently of, or in conjunction with, the biasing provisions between the first jaw and the handle.

In certain versions of the wrenches one or more projections or outwardly extending members such as "finger hooks" can be provided on one or more jaws. An example of a finger hook is shown in FIG. 1 as 75. It will be understood that the present subject matter includes finger hooks or like members on any of the jaws and in a variety of other shapes, configurations, and orientations besides the finger hook 75 depicted in FIG. 1. For example, one or more finger hooks could be provided on the second jaw 40 and/or the first jaw 30 instead of, or in addition to, the third jaw 50. Furthermore, instead of extending radially outward from a jaw, the finger hooks could extend laterally alongside a jaw. A wide array of configurations are contemplated for the finger hooks.

Figure 5:
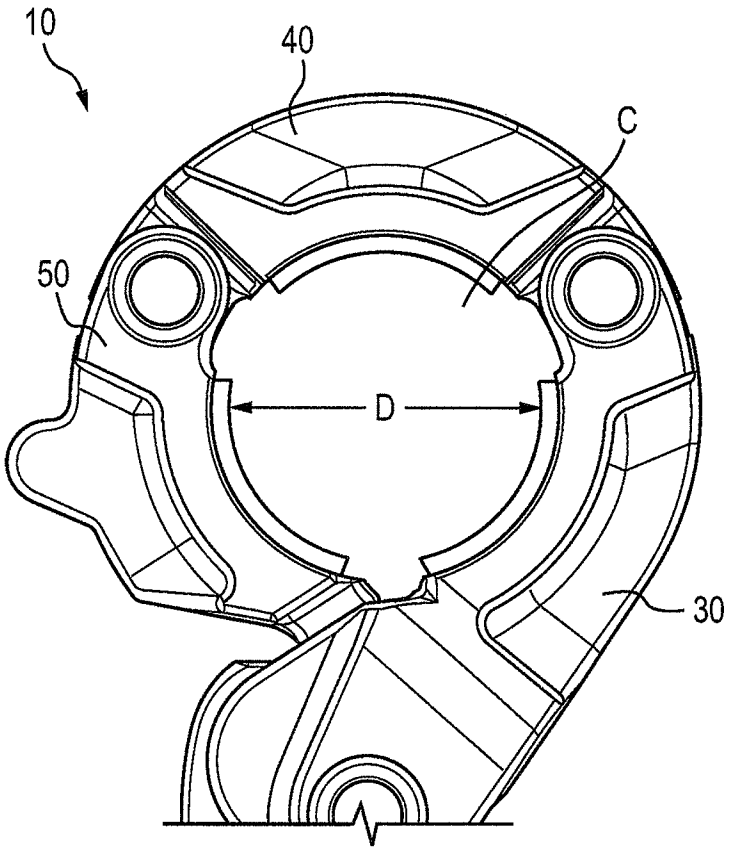
FIG. 5 illustrates the wrench of FIG. 1 in a closed position.
Figure 6:
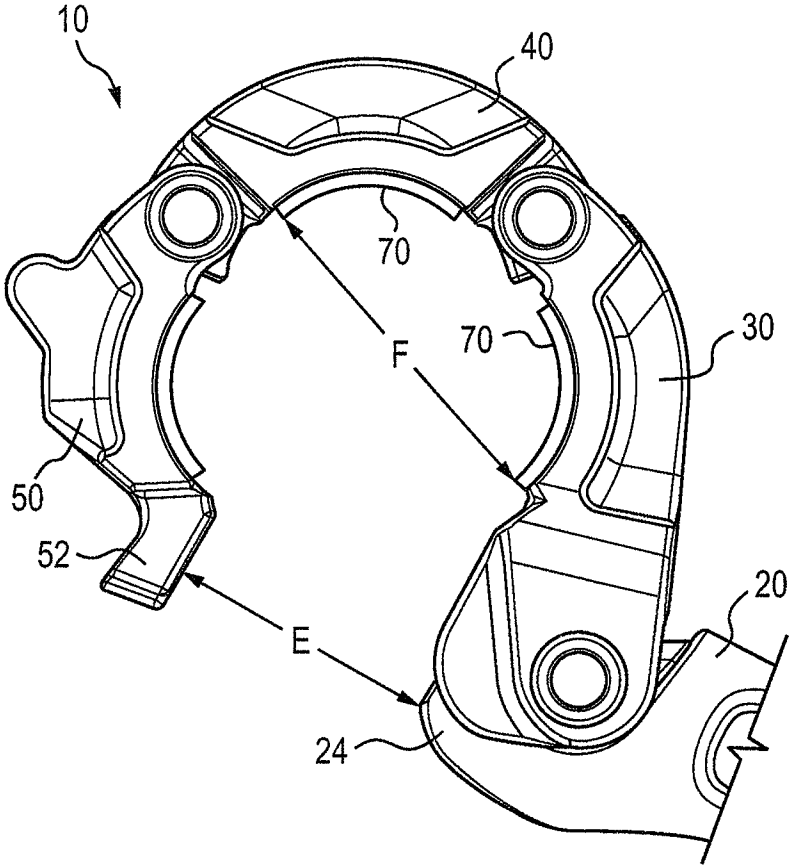
FIG. 6 illustrates the wrench of FIG. 1 in a fully opened position.

The wrenches of the present subject matter may also include a limited articulation feature that limits the extent of opening of the wrench. This feature may be beneficial when using the wrench so that during initial placement or orientation of the wrench such as about an inner tube for example, the plurality of jaws retain a particular arrangement rather than move uncontrollably or unrestrained to other positions such as toward the handle. Keeping the plurality of jaws in a position nearer their closed position increases operating and use efficiency of the wrench. FIG. 5 illustrates the wrench 10 in a closed position and the resulting gripping region C defined between the jaws 30, 40, and 50. FIG. 6 illustrates the wrench 10 in a fully opened position and the limited articulation feature in which the maximum distance between the handle 20, e.g., the distal end 24 of the handle 20, and the third jaw 50, e.g., the distal end 52 of the jaw 50, is limited.

The fully opened position enables radial access to the gripping region by an inner tube or other component to be engaged therein. Specifically, the extent of limited travel between the distal end 52 of the jaw 50 and the distal end 24 of the handle 20, can be expressed with reference to a maximum span or distance between opposing faces of friction material 70 when the wrench is in a closed position. That maximum span when the wrench is in a closed position is depicted in FIG. 5 as closure span D. The maximum distance between the distal end of the third jaw 50 and the handle 20 when the wrench is fully opened is shown in FIG. 6 as span E. In accordance with the limited articulation feature the span E can be expressed as a percentage of closure span D. Thus, in certain versions of the present subject matter, the span E is less than 300% of span D, more particularly less than 250% of span D, more particularly less than 200% of span D, and in certain applications, less than 150% of span D. In the particular version of the wrench depicted in the referenced figures, span E is equal to about 111% of the closure span D.

In another aspect of the present subject matter the limited articulation feature of the jaws can also be expressed with reference to a maximum distance measured between opposite faces of friction material 70 of the first jaw 30 and the second jaw 40 when the wrench is in a fully opened position. That maximum distance is shown in FIG. 6 as span F. In certain versions of the subject matter, the span F is less than 300% of span D, more particularly less than 250% of span D, more particularly less than 200% of span D, and in certain embodiments less than 150% of span D. In the particular version of the wrench shown in the referenced figures, span F is equal to about 142% of the closure span D.

Figure 7:
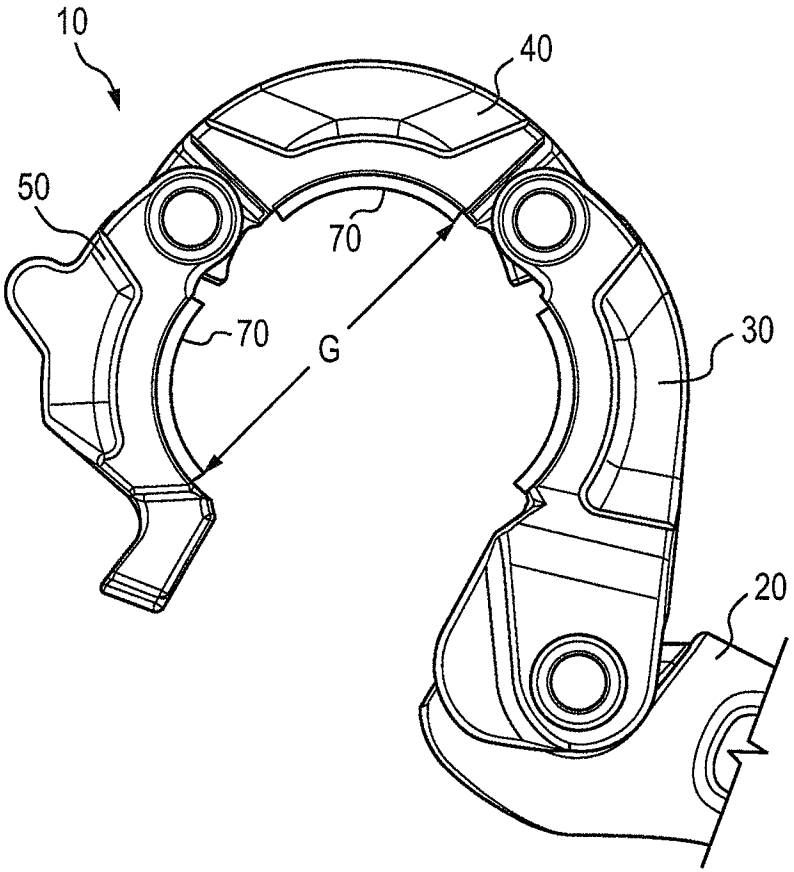
FIG. 7 also illustrates the wrench of FIG. 1 in a fully opened position.

In another aspect of the present subject matter, the limited articulation feature of the jaws can also be expressed with reference to a maximum distance measured between opposite faces of friction material 70 of the second jaw 40 and the third jaw 50 when the wrench is in a fully opened position. That maximum distance is shown in FIG. 7 as span G. In certain versions of the subject matter, the span G is less than 300% of span D, more particularly less than 250% of span D, more particularly less than 200% of span D, and in certain versions less than 150% of span D. In the particular version of the wrench shown in the referenced figures, span G is equal to about 142% of the closure span D.

Wrenches which embody the limited articulation feature may exhibit one or more of these characteristics described in association with the closure span D and spans E, F, and G. Thus, more specifically, such wrenches may exhibit at least one or more of the following: (a) a maximum distance between the distal end of the third jaw and the first end of the handle is less than 300% of the closure span, (b) a maximum distance between opposite interior faces of the first jaw and the second jaw is less than 300% of the closure span, and (c) a maximum distance between opposite interior faces of the second jaw and the third jaw is less than 300% of the closure span.

In certain versions of the wrenches, the limited articulation feature may be expressed by specifying a maximum angular displacement for two adjacent jaws. In particular embodiments, the maximum angular displacement is about 180°. Such a position is depicted in FIG. 6 between the first jaw 30 and the second jaw 40; and in FIG. 7 between the second jaw 40 and the third jaw 50.

Figure 13:
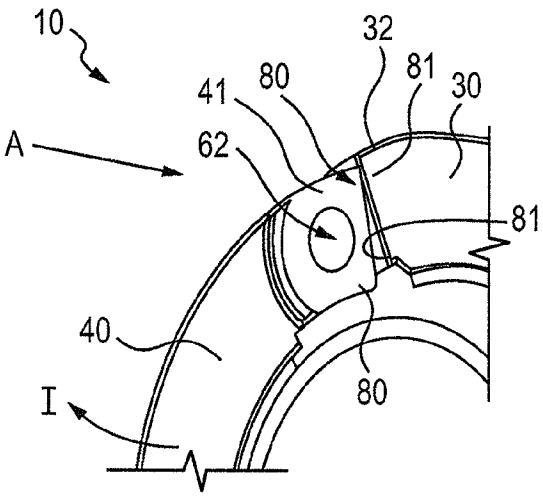
FIG. 13 is a detailed view of a joint between two adjacent jaws of a wrench in accordance with the present subject matter.

FIG. 13 illustrates a configuration that could be provided between adjacent jaws, such as for example at joint A between first and second jaws 30 and 40, to limit articulation or angular extension between those jaws. Specifically, FIG.

13 illustrates the second jaw 40 having one or more outwardly extending shoulders 80 that extend from the proximal end 41 of the jaw 40. The first jaw 30 includes one or more stop surfaces 81 at the distal end 32 of the jaw 30 that are located relatively close and in facing engagement with the shoulder(s) 80 of the second jaw 40. Thus, referring to FIG. 13 it can be seen that upon angular extension of the second jaw 40 relative to the first jaw 30 such as in the direction of arrow I, the shoulder 80 of the second jaw 40 will contact the stop face 81 of the first jaw 30 and preclude or limit any further angular extension. The present subject matter includes the use of a wide array of assemblies and structural arrangements to achieve the limited articulation aspects described herein. Thus, it will be appreciated that the present subject is not limited to any particular assembly as illustrated and/or described herein.

Figure 8:
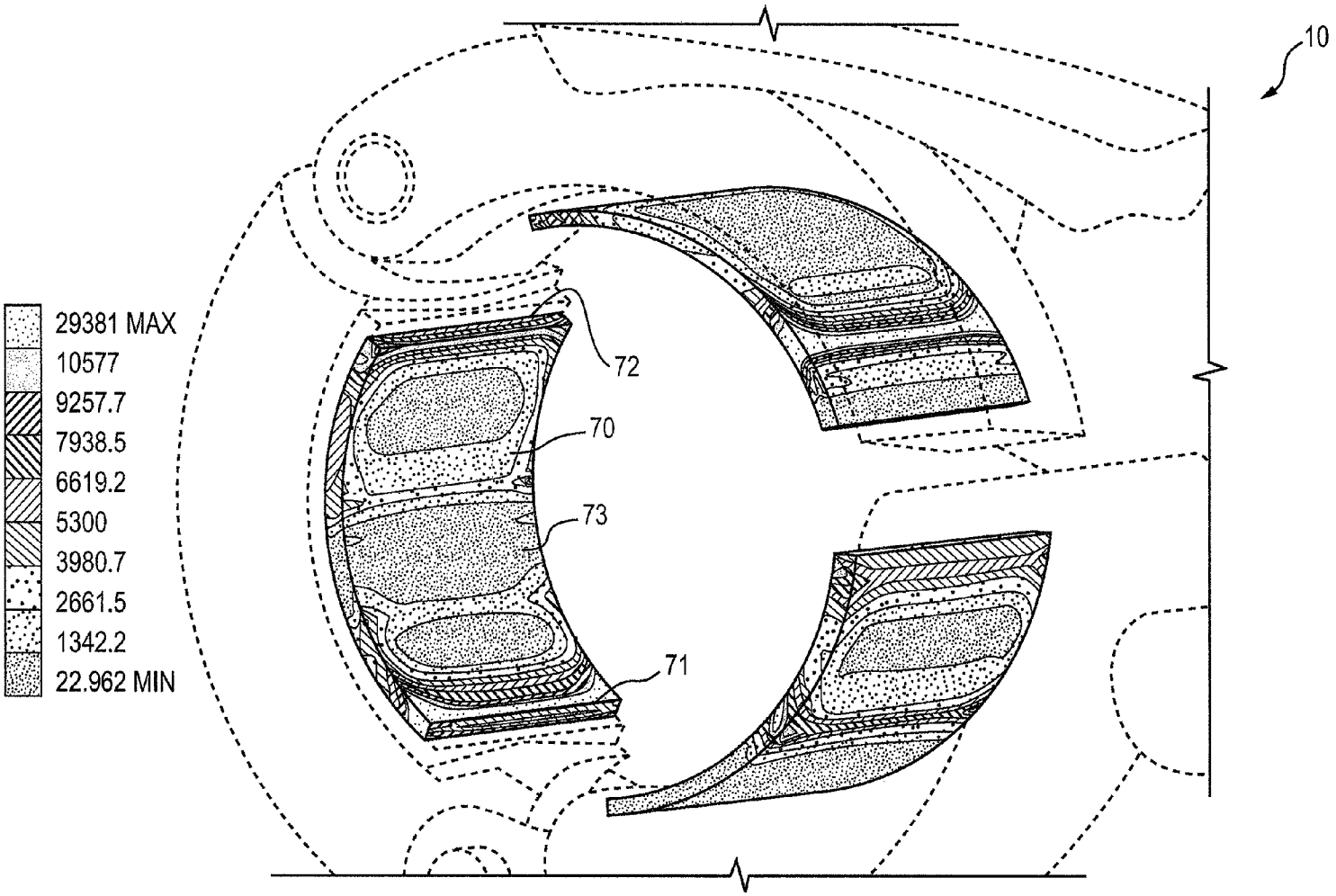
FIG. 8 illustrates contact pressures along regions of friction material during an early phase of load application and engagement with an inner tube or other component.

As previously noted, in certain versions of the present subject matter the friction material is provided in a particular configuration and/or orientation. During initial contact with an outer surface of an inner tube or other cylindrical component, the friction material is configured and/or oriented such that one or more edges or peripheral regions of the friction material contact the inner tube. In certain versions of the wrench, contact between the friction material and the inner tube initially occurs and/or during early phases of torque transfer from the wrench to the inner tube along two opposite edges of each region of friction material. This is shown in FIG. 8 in which a first edge 71 and a second opposite edge 72 of the friction material 70 experience greater stresses during loading than region(s) of the friction material 70 between those edges such as an interior face region 73. It will be appreciated that the noted first and second edges of the friction material generally extend in a direction parallel to a longitudinal axis of an inner tube when the wrench is used on the inner tube.

Figure 9:
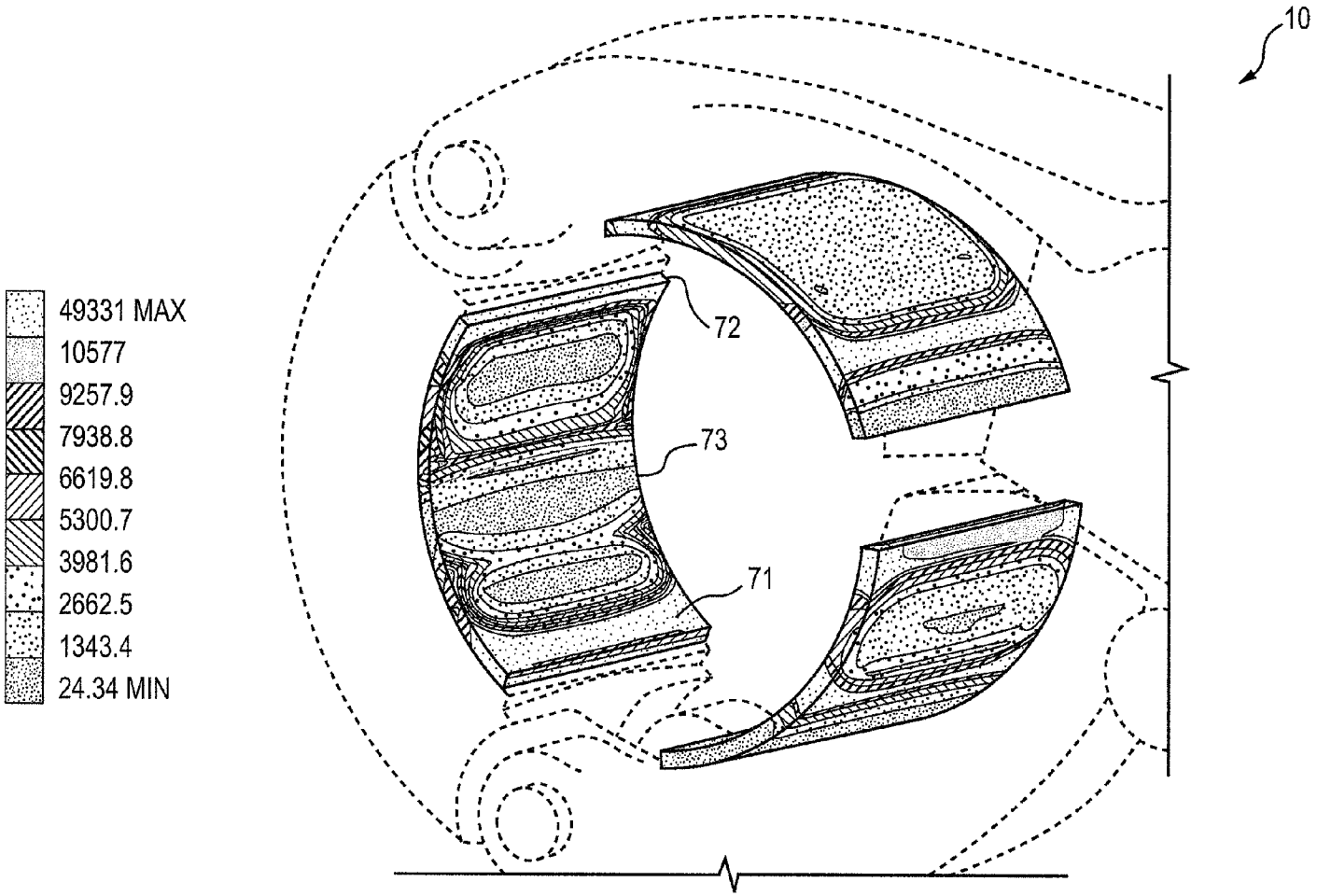
FIG. 9 illustrates distribution of contact pressures along regions of the friction material during application of greater loads.

FIG. 9 illustrates distribution of stresses in the friction material 70 as greater amounts of torque are applied from the wrench to the inner tube. Thus, the area of contact between a face of the friction material and the outer surface of the inner tube increases with increased loads. This is achieved at least in part by forming the faces of the friction material to exhibit an arcuate shape or profile which is defined by a radius that is less than the radius of the outer surface of the inner tube. In certain versions, the radius defining the arcuate profile of the friction material face is within a range of from 99.8% to 98% of the radius of the outer surface of the inner tube. The feature of increasing area of contact between the friction material face and the inner tube as load increases, is also achieved at least in part by use of a compressible friction material as described herein. As previously noted, in certain versions of the present subject matter, the friction material is selected so as to exhibit an elastic modulus value so that the material is compressed during use of the wrench. Materials having an elastic modulus value within a range of from 15 ksi to 1,500 ksi are particularly useful in this regard. These elastic moduli values of the friction materials are much less than that of steel which is a typical material of inner tubes or other cylindrical members. Thus, during use of the wrench and application of loads to the friction material, the friction material conforms to the shape and/or contour of the inner tube or other cylindrical member.

Figure 10:
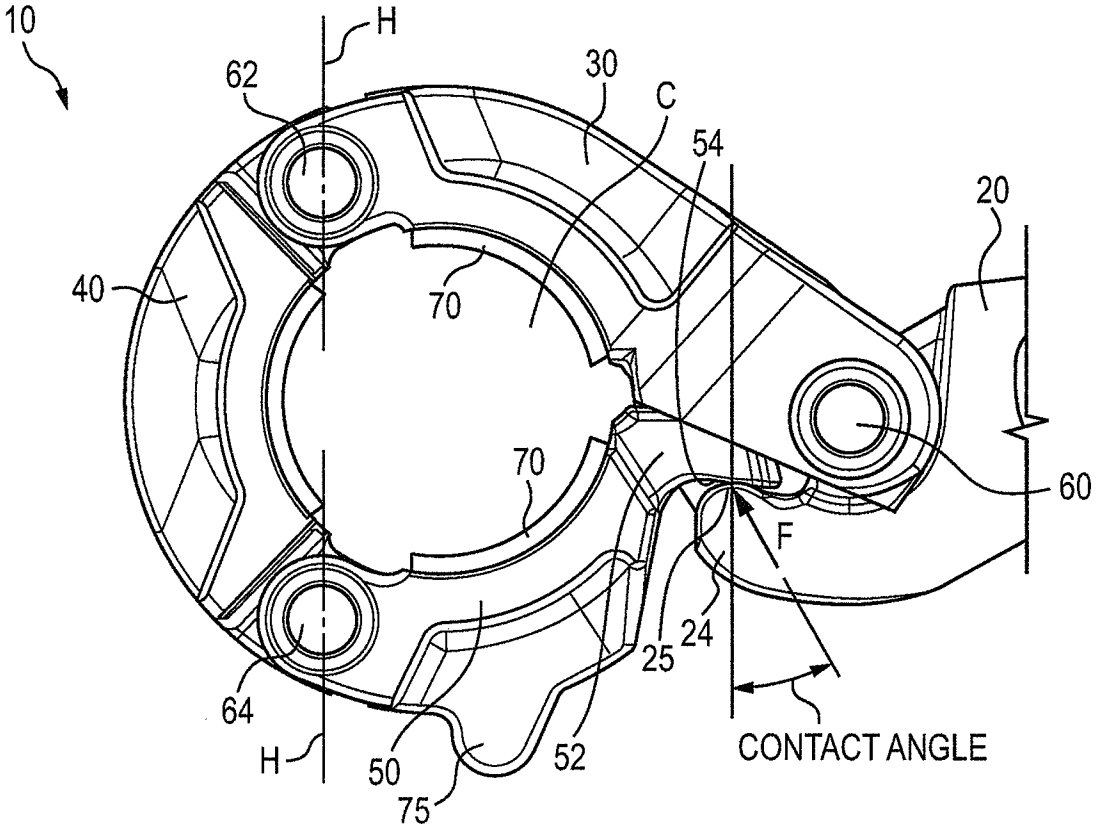
FIG. 10 illustrates an engagement feature between certain components of the wrenches of the present subject matter.

In yet another aspect, the present subject matter also provides particular engagement configurations and the use of certain contact angles between the handle and the distal end of the terminal or third jaw. For example, FIG. 10 illustrates the wrench 10 in a closed position in which contact occurs between a ridge 25 of the handle 20 and an engagement face 54 extending along the distal end 52 of the third jaw 50. As will be understood, upon positioning an inner tube within the gripping region C, slight variations in the diameter of the inner tube are accommodated by changing the contact location between the ridge 25 on the face 54. For example, larger diameters can be accommodated by the ridge 25 moving toward the pivot pin 60 during closing of the wrench. Smaller diameters can be accommodated by the ridge 25 moving away from the pivot pin during wrench closing until sufficient contact occurs between the friction material 70 and the inner tube. In certain versions of the wrenches of the present subject matter, the contact angle between the ridge 25 and the engagement face 54 is within a range of from 10° to 30°, and in still other versions, about 20°, as measured from a plane defined by the center axes of pivot pins 62 and 64. That plane is depicted in FIG. 10 as plane H.

More specifically, the engagement region depicted in the referenced figures and described herein includes an engagement ridge such as the ridge 25 provided on the handle and an engagement face such as face 54 on the terminal or third jaw. However, the present subject matter includes variant configurations. For example, the engagement face can be provided on the handle, and the engagement ridge can be provided on the handle terminal or third jaw.

Figure 11:
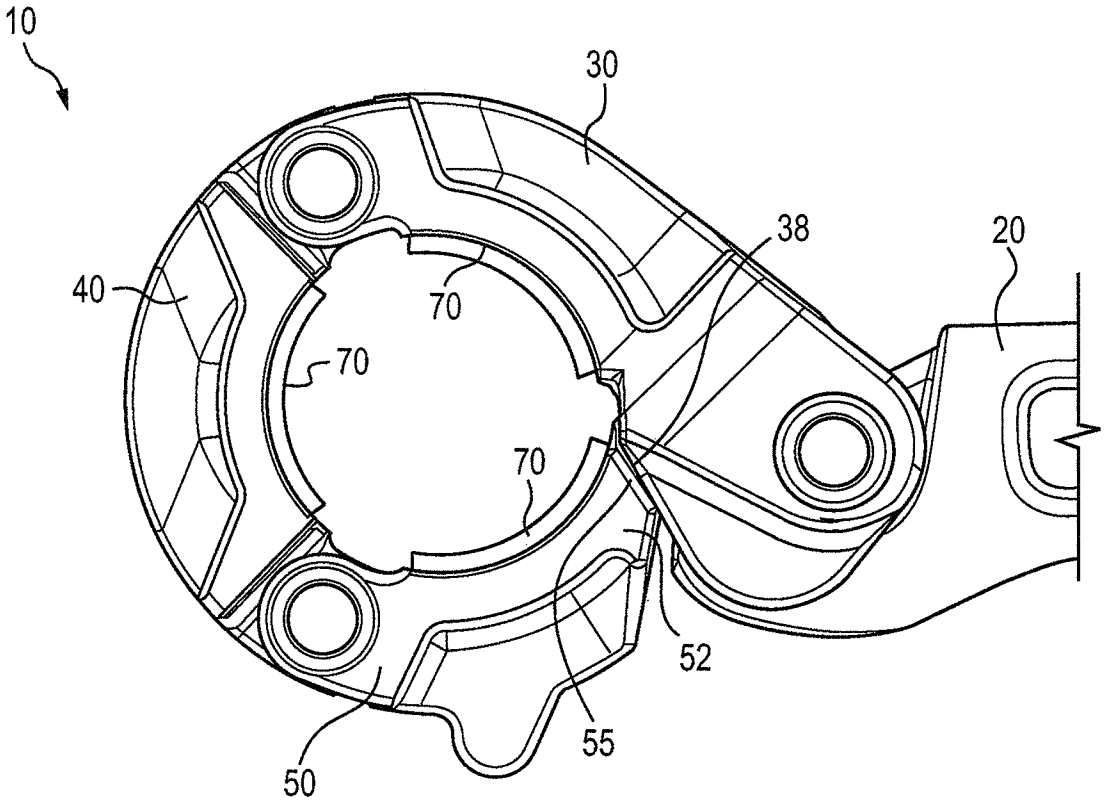
FIG. 11 illustrates a feature for preventing excessive levels of force by the wrenches of the present subject matter.

In yet another aspect of the present subject matter the wrenches can include provisions that limit application of excessive loads, i.e., compressive forces and/or torque, to an inner tube or other cylindrical member disposed in the gripping region when the wrench is in a closed position and a load is applied to the wrench. FIG. 11 illustrates an example of such provisions, referred to herein as a stop feature. FIG. 11 depicts the wrench 10 having the first jaw 30 defining a first stop face 38 and the third jaw 50 defining a second stop face 55. The stop faces 38 and 55 are located on their respective jaws such that they contact one another at a phase of wrench closing that correlates with application of a maximum allowable load to an inner tube or a design point considering a factor of safety, for example 75% of the yield of the inner tube. Due to contact between the stop faces 38 and 55, the span as measured between opposite regions of the friction material reaches a minimum distance. The stop feature may also be understood by considering the locations of the stop faces 38 and 55 relative to one another during use of the wrench. Prior to application of load, the first and second stop faces 38 and 55 are separated from one another. As load is applied to the wrench, friction material compressed, and torque is applied to an inner tube within the gripping region, the first jaw 30 and the third jaw 50 are drawn towards each other. As this occurs, the faces 38 and 55 are displaced toward one another. The faces 38 and 55 are located and positioned in the first and third jaws 30 and 50 such that upon application of a maximum allowable load, the faces 38 and 52 contact one another. Thus, gripping pressure and peak torque of the wrench can be limited. This feature is also described herein in conjunction with a system of a wrench and a cylindrical member having a known diameter.

The present subject matter also includes the use of provisions that enable the selective adjustment of the spacing or distance between the stop faces when the wrench is in a closed position. Thus, by changing the locations of the stop faces relative to one another, the closure span defined by the gripping region when the wrench is closed, can be selectively changed. As will be appreciated, changing the closure span increases or decreases the maximum loads placed upon cylindrical members in the gripping regions and being engaged therein.

Figure 12:
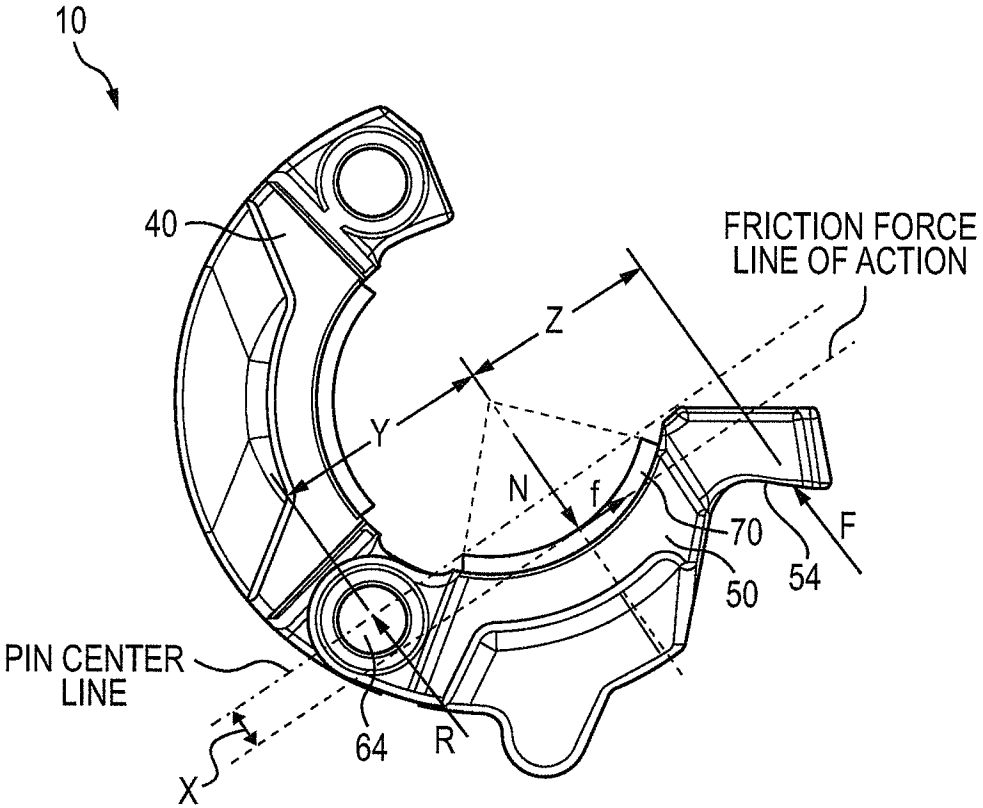
FIG. 12 illustrates a self-locking feature of the wrenches of the present subject matter.

FIG. 12 is a free body diagram illustrating a self-locking feature of certain wrenches in accordance with the present subject matter. That is, in this feature, selective location of a joint or pivot pin between the second and third jaws relative to the jaws can promote further engagement between the third jaw (and other jaws) and the inner tube. Similarly, this feature can also be embodied by selective location of a joint or pivot pin between the first and second jaws relative to those jaws which promotes engagement between the second jaw (and other jaws) and the inner tube. FIG. 12 illustrates the second and third jaws 40 and 50, and their pivot pin 64, during use of the wrench upon an inner tube (not shown) located in the gripping region. Upon application of a force to the wrench handle, the third jaw 50 is displaced by force "F" at the engagement face 54 to impart a force on the friction material 70. The resulting pressure on the friction material 70 is distributed across the surface of the friction material. However, the equivalent (or net) force "N" is directed radially into the center of the friction material. In coulomb friction, this force is known as the normal force. The equivalent (or net) friction force "f" is proportional to "N" and directed at a 90° angle with respect to the normal force to resist the relative motion between the friction material and the inner tube and thereby transmit torque to the inner tube or other cylindrical component. A reaction force "R" acts at the location of the pin 64. Referring further to FIG. 12, it can be seen that the line of action of the friction force "f" corresponds to a line transversely intersecting a plane bisecting the friction material. That is, the transverse line intersects the friction material bisecting plane at right angles.

The force "F" produces gripping pressure (i.e., produces the net force "N") at the friction material 70 by causing a counterclockwise moment of the third jaw 50 about the pin 64. Because the line of action of the friction force "f" is positioned outside the center line of the pin 64, the friction force also produces a counterclockwise moment about the pin 64. Thus, the friction force also contributes to the net force "N". Because the friction force contributes to "N" and is proportional to "N" it is self amplifying to some extent. As a result, the configuration can be said to be self-locking. These relationships can be expressed as equations (I)-(III) considering a statically balanced system:

$$\Sigma M_{pin}=0=F(Y+Z)+f(X)-N(Y) \quad \text{(I)}$$

$$N(Y)=F(Y+Z)+f(X) \quad \text{(II)}$$

$$N(Y)=F(Y+Z)+N\mu(X) \quad \text{(III)}$$

In equations (I)-(III); X, Y, and Z are distances between components or features and μ is the coefficient of friction.

Thus, the self-locking feature of the present subject matter is achieved by locating pivot axis between two adjacent jaws such that a plane extending through the pivot axis and oriented parallel to a line of action of the friction force on either of the jaws, also extends across at least a portion of the gripping region.

In certain versions of the wrench, one or more covers or enclosures may be provided around the region of engagement between the engagement ridge of the handle and the engagement face of the terminal or third jaw. In certain applications it may be beneficial to provide sidewalls or other members that enclose or at least partially enclose the noted engagement region to prevent accumulation of dirt or debris in that region such as for example on the engagement ridge of the handle and/or the engagement face of the terminal jaw. Providing such sidewalls or other members to at least partially enclose the engagement region also limits access to the engagement region.

The present subject matter also provides systems of the wrenches and cylindrical members such as inner tubes having particular outer diameters. In certain embodiments, the wrenches are sized and/or configured for the inner tubes having particular outer diameters. A representative, non-limiting example of such a system is as follows. The system comprises a cylindrical member such as a core barrel inner tube having a known diameter and a maximum allowable load limit associated with the cylindrical member. The system also comprises a wrench including (i) a handle defining a first end and a second end, (ii) a plurality of hingedly connected jaw members, the plurality of jaw members including a primary jaw member pivotally attached to the first end of the handle and a terminal jaw member engageable with the handle, each of the plurality of jaw members defining an interior face, and (iii) a friction material disposed on at least one of the interior faces of the plurality of jaw members. The wrench is positionable between an open position and a closed position. The closed position results in the plurality of jaws defining an enclosed gripping region and a closure span extending between faces of friction material on opposing regions of the plurality of jaws. The wrench is configured such that the closure span is sized relative to the diameter of the cylindrical member so that upon positioning the cylindrical member within the gripping region and positioning the wrench to the closed position, the loads applied to the cylindrical member from the wrench are less than the maximum allowable load limit associated with the cylindrical member.

The wrench may also be configured so that a first stop face is provided on the primary jaw member and a second stop face is provided on the terminal jaw members. The first and second stop faces are located relative to one another such that upon positioning the wrench to the closed position, the first and second stop faces contact one another.

The present subject matter includes a wide range of variant assemblies, configurations, and components. For example, the present subject matter potentially includes versions of wrenches using chain assemblies having friction materials disposed thereon.

Another aspect of the present subject matter involves configuring and/or sizing of the gripping inserts. As will be understood, the total gripping surface area of a collection of gripping inserts can be increased by increasing the total circumferential length of one or more, or all, of the collection of gripping inserts to be utilized in a wrench. Alternatively or in addition, the total gripping surface area of the gripping inserts can be increased by increasing the width of one or more, or all, of the gripping inserts. However, the total gripping surface area must be sufficiently small to distribute radially applied forces or loads to a tube to be gripped, so that sufficient friction can be realized between the inserts and the tube; while sufficiently large to avoid deformation of the tube. A targeted total gripping surface area of the inserts can be evaluated by use of a particular relationship set forth below as Equation (IV):

$$P=\frac{\Delta}{\frac{D_{I,outer}}{E_{outer}}\left(\frac{D_{O,puter}^2+D_{I,outer}^2}{D_{O,outer}^2-D_{I,outer}^2}+\eta_{outer}\right)+\frac{D_{O,inner}}{E_{inner}}\left(\frac{D_{O,inner}^2+D_{I,inner}^2}{D_{O,inner}^2-D_{I,inner}^2}+\eta_{inner}\right)} \quad \text{(IV)}$$

-continued

Equation (IV) enables an estimation of pressure P that can be circumferentially applied to a tubular member $D_I$ (with known inner diameter $D_I$, inner; outer diameter $D_I$, outer; modulus of elasticity $E_I$; and Poisson's ratio $n_{inner}$) using arcuate gripping inserts $D_o$ (positioned in a wrench as described herein to form a known inner diameter $D_o$, inner; and outer diameter $D_o$, outer; and the inserts having a known modulus of elasticity $E_o$; and Poisson's ratio $n_{outer}$).

The interface diameter difference Δ utilized in Equation (IV) is calculated by Equation (V):

$$\Delta = D_I,\text{outer} - D_o,\text{inner} \quad \text{(V)}$$

The interface diameter difference Δ corresponds to the difference between the outer diameter of the tubular member to be gripped and the inner diameter of the gripping inserts when positioned in a wrench.

After identifying a maximum yield value for the tubular member (to be gripped) and a margin factor of safety value, an assessment of whether the proposed gripping inserts can be used without deforming the tubular member can be made as described in greater detail herein.

Figure 15:
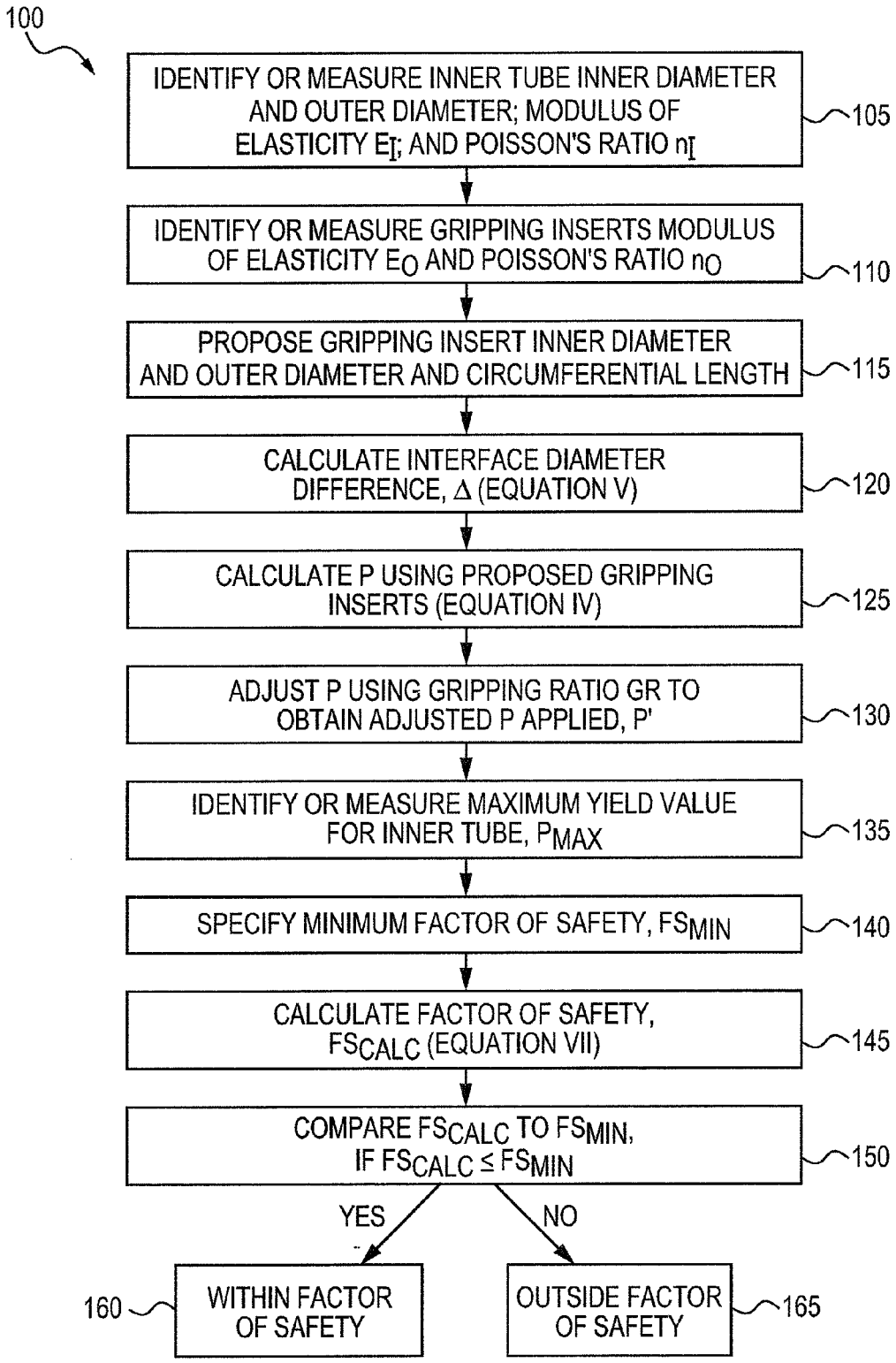
FIG. 15 schematically illustrates a method for evaluating gripping inserts in accordance with the present subject matter.

FIG. 15 schematically illustrates a method 100 for evaluating a gripping insert, or a collection of gripping inserts for a particular workpiece or tube to be gripped. In a first phase depicted in FIG. 15 as operations 105-130, the method 100 involves identification of various dimensions of the tube, i.e., inner and outer diameters; and certain material properties of the tube and the gripping insert(s), i.e., modulus of elasticity E and Poisson's ratio n. The method 100 also uses estimated or proposed dimensions of the proposed gripping inserts, i.e., inner and outer diameters and total circumferential length of the gripping faces of the inserts. The method 100 provides a circumferential pressure P that can be applied to the tube using the proposed gripping insert(s), and then adjusts that pressure based upon a gripping ratio GR to obtain a calculated applied pressure using the gripping inserts, P'.

In a second phase of the method 100 in FIG. 15 shown as operations 135-165, a maximum yield value for the inner tube is identified, $P_{MAX}$. The method also comprises specifying a minimum factor of safety and then comparing that specified value to a calculated factor of safety value, $FS_{CALC}$. The comparison enables an assessment of whether the proposed gripping inserts can be used in conjunction with the noted tube and under the noted safety range.

Figure 16:
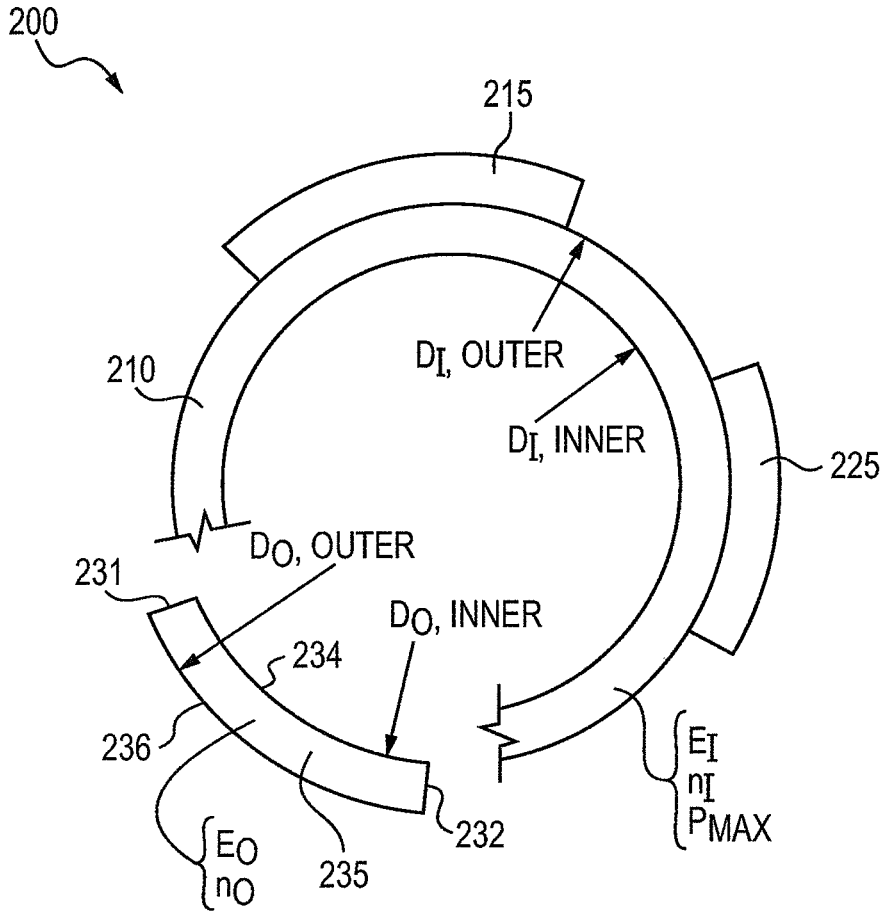
FIG. 16 is a schematic illustration showing a plurality of gripping inserts positioned about a tube to be gripped, and various designations used herein.

More specifically and for example, the method 100 can be performed upon a system 200 of three (3) gripping inserts 215, 225, and 235 positioned circumferentially around a tube 210 to be gripped and equidistant from one another, as shown in FIG. 16. Referring to FIGS. 15 and 16, the method 100 comprises one or more operations 105 of identifying or measuring the inner diameter and the outer diameter of the tube 210 to be gripped, i.e., the "inner tube." The inner diameter of the inner tube is referred to herein as "$D_I$, inner" and shown on FIG. 16. The outer diameter of the inner tube is referred to herein as "$D_I$, outer" and shown on FIG. 16. The operation(s) 105 also include obtaining the modulus of elasticity of the inner tube referred to herein as "$E_I$" and Poisson's ratio of the inner tube referred to herein as "$n_I$."

The method 100 also comprises one or more operations 110 of identifying or measuring the modulus of elasticity of the gripping inserts referred to herein as "$E_o$", and Poisson's ratio for the gripping inserts referred to herein as "$n_o$". The properties of $E_o$ and $n_o$ are with regard to the material of the substrate of the gripping insert. The operations of identifying or measuring the noted properties are performed if the material of the substrate of the gripping insert is known or proposed. It will be understood that the method includes directly proposing values for the noted properties.

The method 100 also comprises one or more operations 115 of proposing a configuration or size for the gripping inserts. Typically, if a collection of gripping inserts are to be used together, each gripping insert has identical dimensions and shape, i.e., curvature and arcuate form. Thus, operation(s) 115 propose an inner diameter for each gripping insert which is referred to herein as "$D_o$, inner" and shown in FIG. 16. The operation(s) 115 also propose an outer diameter for each gripping insert which is referred to herein as "$D_o$, outer" and shown in FIG. 16. It will be understood that specifying the inner diameter and the outer diameter of a gripping insert is equivalent to specifying a thickness for that insert. The operations 115 also include proposing a total circumferential length for the collection of gripping inserts which for each gripping insert is an arcuate length dimension as shown in FIG. 16 measured along an inner face 234 from one end 231 to an opposite end 232 of the gripping insert 235 for example. The inner face 234 is the face that contacts, i.e., grips, the tube 210. The inner face 234 is oppositely directed from an outer face 236. Upon attaching or mounting the gripping insert 235 in a wrench, the outer face 236 typically contacts a jaw of the wrench. Thus, the total circumferential length is the sum of the arcuate lengths of each gripping insert.

The method 100 also comprises an operation 120 of calculating an interface diameter difference Δ, using Equation (V).

After calculating pressure P using Equation (IV) in operation 125, that pressure can be adjusted in operation 130 using a gripping ratio GR to obtain an adjusted pressure P' which can be applied using the gripping ratio of the proposed inserts. This is shown in Equation (VI) below. The gripping ratio GR is the proportion of circumferential contact between all of the gripping inserts and the tube to be gripped. As an example, for a collection of gripping inserts that contact a tube along ⅔ of its circumference, the gripping ratio would be 0.666.

$$P' = P \cdot GR \quad \text{(VI)}$$

FIG. 15 schematically depicts a second phase of the method 100 which includes one or more operations 135 of identifying or measuring a maximum yield value for the inner tube, $P_{MAX}$. This is the maximum pressure that can be applied to the inner tube without deforming the inner tube.

The method 100 also comprises one or more operations 140 of specifying a minimum factor of safety, $FS_{MIN}$. Depending upon the situation, industry, regulations, or other criteria, this factor may be from about 1.5 to 100 or more. In certain applications, this factor can be about 20 for example.

The method also comprises calculating a factor of safety value, $FS_{CALC}$. The $FS_{CALC}$ is determined by using the $P_{MAX}$ value obtained in operation 135 and dividing that value by the adjusted pressure P' obtained in operation 130 as set forth in Equation (VII):

$$FS_{CALC} = P_{MAX}/P' \quad \text{(VII)}$$

This is shown in FIG. 15 as operation 145.

The method also comprises one or more operations 150 of comparing the calculated factor of safety value $FS_{CALC}$ with the minimum factor of safety value $FS_{MIN}$ specified in operation 140. If the calculated factor $FS_{CALC}$ is less than or equal to the minimum factor $FS_{MIN}$, then the proposed gripping inserts are within the designated factor of safety, as shown at 160. If $FS_{CALC}$ is not less than or equal to $FS_{MIN}$, i.e., greater than, then the proposed gripping inserts are not within the designated factor of safety, as shown at 165. Thus, the method 100 provides a convenient technique for evaluating proposed gripping inserts, i.e., their materials and/or size and configuration, for use in gripping a particular workpiece.

EXAMPLES

Table 1 set forth below summarizes the terms and lists representative values which lead to a calculated circumferential pressure P using Equation (IV) that can be applied using gripping inserts having the proposed values set forth in the table.

TABLE 1

Representative Values for Terms in Equation (IV)

| Term | Designation | Units | Value | Notes |
|---|---|---|---|---|
| Pressure | P | (PSI) | 4596.928 | |
| Inner Tube, Outer Diameter | $D_I$, outer | (in) | 2.195 | Given by ISO 10097 |
| Inner Tube, Outer Diameter | $D_I$, inner | (in) | 1.969 | Given by ISO 10097 |
| Outer Tube, Outer Diameter | $D_O$, outer | (in) | 4.06 | |
| Outer Tube, Outer Diameter | $D_O$, inner | (in) | 2.191 | |
| Modulus of Elasticity for Outer Tube | $E_{Outer}$ | (PSI) | 23500000 | Material Constant of D-4512 Casting |
| Modulus of Elasticity for Inner Tube | $E_{Inner}$ | (PSI) | 29700000 | Material Constant of Coring Tube |
| Poisson's Ratio Inner Tube | $\eta_{outer}$ | | 0.29 | Material Constant of Coring Tube |
| Poisson's Ratio Outer Tube | $\eta_{inner}$ | | 0.28 | Material Constant of D-4512 Casting |
| Interface Diameter Difference | $\Delta$ | (in) | 0.004 | |

After calculating a pressure P of 4596.928 PSI which can be applied using gripping inserts as indicated in Table 1, the pressure P is adjusted using a gripping ratio GR according to Equation (VI) to arrive at an adjusted pressure P'. Using a gripping ratio of 0.514 associated with the gripping inserts of Table 1 results in an adjusted pressure P' of 2361.86 PSI that can be applied to the tube of Table 1.

Assessment of whether the adjusted pressure that can be applied, P' is within a desired factor of safety is performed by identifying or measuring a maximum yield value for the inner tube, $P_{MAX}$. Using a maximum yield value of 50,000 PSI for the inner tube for example, that value is divided by P' to arrive at a calculated factor of safety value. Comparison of the calculated factor of safety value with a desired or minimum factor of safety value provides an indication as whether the proposed gripping inserts are within the desired factor of safety.

Specifically, using the previously determined adjusted pressure P' of 2361.86 PSI, $P_{MAX}$ of 50,000 PSI, and Equation (VII), leads to a calculated factor of safety $FS_{CALC}$ of 21.16974. Assuming a minimum factor of safety $FS_{MIN}$ of 20, enables a comparison between the factors of safety and assessment that the proposed system is within an acceptable factor of safety.

Many other benefits will no doubt become apparent from future application and development of this technology.

All patents, applications, published applications, standards and articles noted herein are hereby incorporated by reference in their entirety.

It will be understood that any one or more feature or component of one embodiment described herein can be combined with one or more other features or components of another embodiment. Thus, the present subject matter includes any and all combinations of components or features of the embodiments described herein.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A replaceable gripping insert adapted for use in a wrench having a plurality of jaw members, at least some of the jaw members having provisions to receive and retain the gripping insert, the gripping insert comprising:

a substrate defining a concave inner face, the substrate exhibiting a Rockwell Hardness C along the inner face within a range of from 40 to 49; and a layer including a metal carbide disposed along the inner face of the substrate and bonded thereto, the layer defining an exposed gripping surface.

2. The gripping insert of claim 1 wherein the substrate exhibits a Rockwell Hardness C along the inner face of the substrate of from 45 to 48.

3. The gripping insert of claim 2 wherein the substrate exhibits a Rockwell Hardness C along the inner face of the substrate of 47.

4. The gripping insert of claim 1 wherein the substrate is formed from wrought iron.

5. The gripping insert of claim 4 wherein the wrought iron is 4140 wrought iron.

6. The gripping insert of claim 1 wherein the layer including the metal carbide disposed on the substrate has a thickness of from 0.0045 inches to 0.0075 inches.

7. The gripping insert of claim 1 wherein the metal carbide is tungsten carbide.

8. A wrench comprising:

a handle defining a first end and a second end opposite from the first end;

a first jaw having a proximal end, a distal end, the first jaw defining an interior face, the proximal end of the first jaw pivotally attached to the first end of the handle;

a second jaw having a proximal end, a distal end, the second jaw defining an interior face, the proximal end of the second jaw pivotally attached to the distal end of the first jaw at a first joint assembly;

a third jaw having a proximal end, a distal end, the third jaw defining an interior face, the proximal end of the third jaw pivotally attached to the distal end of the second jaw at a second joint assembly, the distal end of the third jaw being releasably engageable with the first end of the handle;

at least one gripping insert attached to an interior face of at least one of the first jaw, the second jaw, and the third jaw, the gripping insert including (i) a substrate defining a concave inner face, the substrate exhibiting a Rockwell Hardness C along the inner face within a range of from 40 to 49, and (ii) a layer including a metal carbide disposed along the inner face of the substrate and bonded thereto, the layer defining an exposed gripping surface.

9. The wrench of claim 8 wherein the wrench comprises a first gripping insert attached to the first jaw, a second gripping insert attached to the second jaw, and a third gripping insert attached to the third jaw.

10. The wrench of claim 8 wherein the at least one gripping insert is removably attached to at least one of the first jaw, the second jaw, and the third jaw.

11. The wrench of claim 8 wherein the substrate exhibits a Rockwell Hardness C along the inner face of the substrate of from 45 to 48.

12. The wrench of claim 11 wherein the substrate exhibits a Rockwell Hardness C along the inner face of the substrate of 47.

13. The wrench of claim 8 wherein the substrate is formed from wrought iron.

14. The wrench of claim 13 wherein the wrought iron is 4140 wrought iron.

15. The wrench of claim 8 wherein the layer including the metal carbide disposed on the substrate has a thickness of from 0.0045 inches to 0.0075 inches.

16. The wrench of claim 8 wherein the metal carbide is tungsten carbide.

17. A wrench comprising:

a handle defining a first end and a second end;

a plurality of hingedly connected jaw members, the plurality of jaw members including a primary jaw member pivotally attached to the first end of the handle and a terminal jaw member engageable with the handle, each of the plurality of jaw members defining an interior face;

at least one gripping insert attached to an interior face of at least one of the plurality of jaw members, the gripping insert including (i) a substrate defining a concave inner face, the substrate exhibiting a Rockwell Hardness C along the inner face within a range of from 40 to 49, and (ii) a layer including a metal carbide disposed along the inner face of the substrate and bonded thereto, the layer defining an exposed gripping surface.

18. The wrench of claim 17 wherein the wrench comprises a plurality of gripping inserts, each gripping insert attached to a corresponding jaw member.

19. The wrench of claim 17 wherein the at least one gripping insert is removably attached to at least one of the plurality of jaw members.

20. The wrench of claim 17 wherein the substrate exhibits a Rockwell Hardness C along the inner face of the substrate of from 45 to 48.

21. The wrench of claim 20 wherein the substrate exhibits a Rockwell Hardness C along the inner face of the substrate of 47.

22. The wrench of claim 17 wherein the substrate is formed from wrought iron.

23. The wrench of claim 22 wherein the wrought iron is 4140 wrought iron.

24. The wrench of claim 17 wherein the layer including the metal carbide disposed on the substrate has a thickness of from 0.0045 inches to 0.0075 inches.

25. The wrench of claim 17 wherein the metal carbide is tungsten carbide.

26. A method for evaluating whether use of proposed gripping inserts in a wrench with a particular tube is within a specified factor of safety, the method comprising:

identifying an inner diameter of the tube, an outer diameter of the tube, a modulus of elasticity of the tube, and Poisson's ratio of the tube;

proposing a modulus of elasticity of the gripping inserts, and Poisson's ratio of the gripping inserts;

proposing an inner diameter of the gripping inserts, an outer diameter of the gripping inserts, and a circumferential length of the gripping inserts;

calculating a circumferential pressure P using the proposed gripping inserts, wherein the circumferential pressure P is calculated via Equations (IV) and (V);

determine a gripping ratio GR using the proposed gripping inserts;

calculating an adjusted pressure P' using Equation (VI);

identifying a maximum yield value for the tube, $P_{MAX}$;

specifying a minimum factor of safety, $FS_{MIN}$;

calculating a factor of safety, $FS_{CALC}$ using Equation (VII);

comparing the calculated factor of safety $FS_{CALC}$ to the minimum factor of safety $FS_{MIN}$;

wherein Equation (IV) is:

$$P' = \frac{\Delta}{\frac{D_{I,outer}}{E_{outer}}\left(\frac{D_{O,outer}^2 + D_{I,outer}^2}{D_{O,outer}^2 - D_{I,outer}^2} + \eta_{outer}\right) + \frac{D_{O,inner}}{E_{inner}}\left(\frac{D_{O,inner}^2 + D_{I,inner}^2}{D_{O,inner}^2 - D_{I,inner}^2} - \eta_{inner}\right)};$$

Equation (V) is:

$$\Delta = D_{I,\text{outer}} - D_{o,\text{inner}};$$

Equation (VI) is:

$$P' = P \cdot GR;$$

Equation VII is:

$$FS_{CALC} = P_{MAX}/P';$$

whereby (i) if the calculated factor of safety $FS_{CALC}$ is less than or equal to the minimum factor of safety $FS_{MIN}$, then the proposed gripping inserts are within the specified factor of safety, and (ii) if the calculated factor of safety $FS_{CALC}$ is greater than the minimum factor of safety $FS_{MIN}$, then the proposed gripping inserts are not within the specified factor of safety.

* * * * *